US009849669B2

(12) United States Patent
Fukazawa et al.

(10) Patent No.: US 9,849,669 B2
(45) Date of Patent: Dec. 26, 2017

(54) RECORDING METHOD AND RECORDING APPARATUS

(71) Applicant: SEIKO EPSON CORPORATION, Tokyo (JP)

(72) Inventors: Masahiro Fukazawa, Chino (JP); Akito Sato, Matsumoto (JP); Naoki Sudo, Shiojiri (JP); Hiroki Sato, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 37 days.

(21) Appl. No.: 14/944,705

(22) Filed: Nov. 18, 2015

(65) Prior Publication Data

US 2016/0144613 A1 May 26, 2016

(30) Foreign Application Priority Data

Nov. 25, 2014 (JP) ..... 2014-238089

(51) Int. Cl.
*B41J 2/21* (2006.01)
*B41J 2/045* (2006.01)
(Continued)

(52) U.S. Cl.
CPC ..... *B41J 2/0451* (2013.01); *B41J 2/04581* (2013.01); *B41J 2/2139* (2013.01);
(Continued)

(58) Field of Classification Search
CPC ..... B41J 2/0451; B41J 2/2139; B41J 2/2142; B41J 2/04581; B41J 19/142; B41J 2002/14354
See application file for complete search history.

(56) References Cited

U.S. PATENT DOCUMENTS 6,293,645 B1 * 9/2001 Kim ..... B41J 2/16579 347/19
6,425,699 B1 * 7/2002 Doval ..... B41J 11/42 347/16
(Continued)

FOREIGN PATENT DOCUMENTS

JP 09-024609 1/1997
JP 2005-067049 A 3/2005
(Continued)

*Primary Examiner* — Julian Huffman
*Assistant Examiner* — Michael Konczal
(74) *Attorney, Agent, or Firm* — Foley & Lardner LLP

(57) ABSTRACT

A recording method for performing recording on a medium by forming dots by ejecting a liquid from nozzles during scanning. The recording method includes detecting an abnormal nozzle; disposing a normal nozzle in a row where dot missing occurs due to the abnormal nozzle by moving a medium by a first moving amount; performing first complementary recording in which at least a part of a dot missing region is complemented by a first dot which is recorded by the normal nozzle during the scanning; moving the medium by a second moving amount; and performing second complementary recording in which a second dot of which a size is greater than a size of a dot determined based on printing data is recorded on a row adjacent to a row of the abnormal nozzle by the normal nozzle that is positioned adjacent to the abnormal nozzle during the scanning.

10 Claims, 14 Drawing Sheets

(51) Int. Cl.
*B41J 19/14* (2006.01)
*B41J 2/14* (2006.01)

(52) U.S. Cl.
CPC ..... *B41J 2/2142* (2013.01); *B41J 19/142* (2013.01); *B41J 2002/14354* (2013.01)

(56) References Cited

U.S. PATENT DOCUMENTS

| | | | | |
|---|---|---|---|---|
| 6,478,400 | B1 | 11/2002 | Endo | |
| 6,575,549 | B1 * | 6/2003 | Silverbrook | B41J 2/2139 347/14 |
| 6,802,588 | B2 * | 10/2004 | Garbacz | B41J 2/16552 347/28 |
| 7,387,361 | B1 * | 6/2008 | Rueby | B41J 2/2139 347/15 |
| 7,648,216 | B2 * | 1/2010 | See Toh | B41J 2/2139 347/104 |
| 8,322,814 | B2 | 12/2012 | Hirato et al. | |
| 2015/0251416 | A1 * | 9/2015 | Ochiai | B41J 2/04573 347/14 |

FOREIGN PATENT DOCUMENTS

| | | | |
|---|---|---|---|
| JP | 2012-071568 | A | 4/2012 |
| WO | WO 00/38927 | A1 | 7/2000 |

* cited by examiner

AIR BUBBLE IS MIXED

DRIED

PAPER DUST IS ATTACHED

ABNORMAL NOZZLE DETECTION PASS

NEXT PASS OF ABNORMAL NOZZLE DETECTION PASS

AFTER FOLLOWING NEXT PASS OF ABNORMAL NOZZLE DETECTION PASS

ABNORMAL NOZZLE DETECTION PASS

NEXT PASS OF ABNORMAL NOZZLE DETECTION PASS

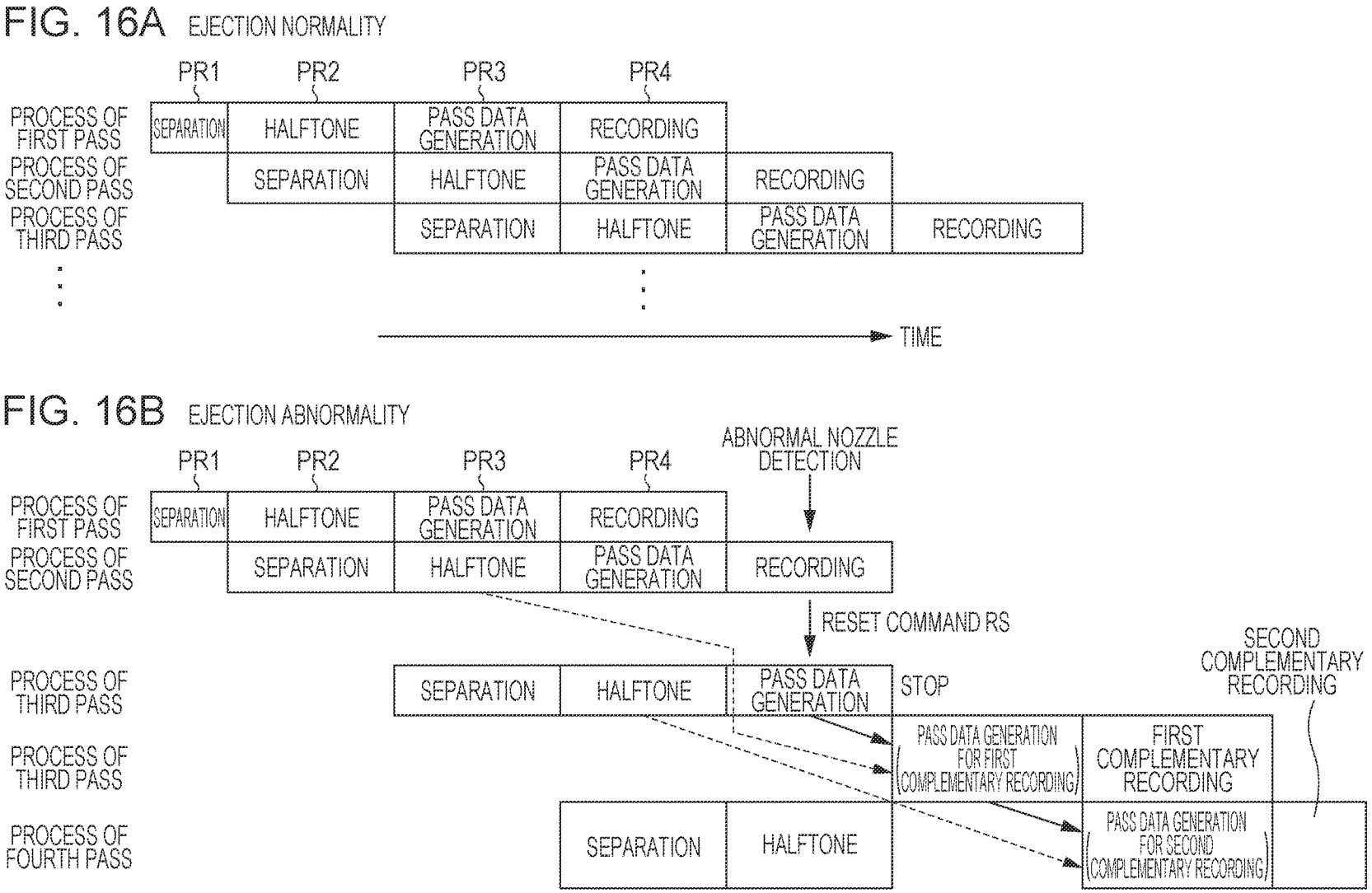
FIG. 16A EJECTION NORMALITY
PR1
PR2
PR3
PR4
PROCESS OF FIRST PASS
PROCESS OF SECOND PASS
PROCESS OF THIRD PASS
SEPARATION
HALFTONE
PASS DATA GENERATION
RECORDING
SEPARATION
HALFTONE
PASS DATA GENERATION
RECORDING
SEPARATION
HALFTONE
PASS DATA GENERATION
RECORDING
TIME
FIG. 16B EJECTION ABNORMALITY
PROCESS OF FIRST PASS
PROCESS OF SECOND PASS
PROCESS OF THIRD PASS
PROCESS OF THIRD PASS
PROCESS OF FOURTH PASS
ABNORMAL NOZZLE DETECTION
RESET COMMAND RS
STOP
SECOND COMPLEMENTARY RECORDING
FIRST COMPLEMENTARY RECORDING
PASS DATA GENERATION FOR FIRST (COMPLEMENTARY RECORDING)
PASS DATA GENERATION FOR SECOND (COMPLEMENTARY RECORDING)

RECORDING METHOD AND RECORDING APPARATUS

CROSS-REFERENCE TO RELATED APPLICATIONS

This application claims priority to Japanese Patent Application No. 2014-238089 filed on Nov. 25, 2014. The entire disclosure of Japanese Patent Application No. 2014-238089 is hereby incorporated herein by reference.

BACKGROUND

1. Technical Field

The present invention relates to a recording method and a recording apparatus in which a dot missing portion due to nozzles of ejection abnormality is made inconspicuous by dots due to normal nozzles when performing recording by forming the dots by ejecting liquid such as ink from the nozzles in the course of moving a recording section.

2. Related Art

Conventionally, as this kind of the recording apparatus, an ink jet type printer, which performs printing of a document or an image on a medium such as a sheet by forming dots by ejecting ink (an example of liquid) from a plurality of nozzles included in a recording head, has been known. As such a printer, for example, a serial printer, a lateral type printer, and the like have been known, in which in the middle of moving of a carriage having the recording head in a scanning direction intersecting a nozzle column direction of the recording head, the image and the like are printed on the medium by ejecting liquid droplets (ink droplets) from the nozzles.

However, if the nozzles cause ejection abnormality, a white streak, in which the dots miss along the scanning direction, occurs on a printed image on the medium and printing quality is lowered. If printing quality does not satisfy certain requirements and printing is failed due to presence of such a white streak, the ink and the medium such as the sheet which are consumed in printing are wasted.

For example, a recording apparatus, which includes a detection device detecting abnormal nozzles based on a read image by printing a test pattern at a portion other than a printing region and optically reading the test pattern, is disclosed in JP-A-2012-71568. However, since the abnormal nozzles cannot be detected during printing, previous printing is likely to have failed due to the presence of a white streak and the like, even if the abnormal nozzles can be detected by printing of the test pattern.

Furthermore, a recording method in which if the abnormal nozzles are detected during moving of the recording head, the dot missing portion due to the abnormal nozzles is complemented with dots by normal nozzles in the next scanning of the recording head after transporting in which a transport amount of the medium is changed is disclosed in International Publication No. WO00/38927. According to the recording method, since a white streak can be reduced by complementation of the dots using the normal nozzles, it is possible to reduce a frequency of failure of printing.

Furthermore, for example, recording methods in which if the abnormal nozzles (non-ejecting nozzles) occur during moving of the recording head, missing of the dots is made inconspicuous by increasing the recording density of adjacent dots by increasing an ejecting amount of dots (pixels) adjacent to dots which were to be originally printed by the abnormal nozzles are disclosed in JP-A-2005-67049 and JP-A-9-24609.

However, in the recording method described in International Publication No. WO00/38927, since next scanning for complementing the dot missing portion due to the abnormal nozzles is supplementary scanning performing only complementation of the dots, a throughput of recording is reduced.

On the other hand, according to the recording methods described in JP-A-2005-67049 and JP-A-9-24609, supplementary scanning for complementing the dot missing portion by the dots is not increased, but since white streak is inconspicuous by increasing the recording density by increasing the ejecting amount of the dots adjacent to the dots which have to be formed by the abnormal nozzles, print quality is slightly lowered compared to print quality before the abnormal nozzles occur.

SUMMARY

An advantage of some aspects of the invention is to provide a recording method and a recording apparatus in which even if abnormal nozzles occur, lowering of recording quality caused by dot missing can be suppressed without seriously lowering the throughput of recording.

Hereinafter, means of the invention and operation effects thereof will be described.

According to an aspect of the invention, there is provided a recording method for performing recording on a medium by forming dots by ejecting a liquid from nozzles during scanning in which a recording section having a nozzle column formed of a plurality of nozzles is moved in a scanning direction intersecting the nozzle column, the recording method including: detecting an abnormal nozzle by a detection section during scanning of the recording section; disposing a normal nozzle in a row where dot missing occurs due to an abnormal nozzle by relatively moving a medium and the recording section by a first moving amount that is shorter than a defined moving amount if the abnormal nozzle is not detected before first scanning corresponding to the next scanning in a case where the abnormal nozzle is detected in the scanning; performing first complementary recording in which at least a part of a dot missing region in the first scanning is complemented by a first dot which is recorded by the normal nozzle; relatively moving the medium and the recording section by a second moving amount remaining to a position that is transported by the defined moving amount before a second scanning that is the next scanning of the first scanning; and performing second complementary recording in which a second dot of which a size is greater than a size of a dot determined based on printing data is recorded on a row adjacent to a row of the abnormal nozzle by the normal nozzle that is positioned adjacent to the abnormal nozzle in the nozzle column direction.

In this case, at least a part of the dot missing region due to the abnormal nozzles occurring in the scanning before the first scanning is complemented by the normal nozzle in the next first scanning. In the second scanning, the second complementary recording in which the second dot of which the size is greater than the size of the dot determined based on the printing data recorded on the row adjacent to the row of the abnormal nozzle by the normal nozzle that is positioned adjacent to the abnormal nozzle is performed. Thus, even if the abnormal nozzle occurs, it is possible to suppress lowering of recording quality caused by dot missing without seriously lowering the throughput of recording.

It is preferable that in the performing of the first complementary recording, a size of the first dot that is recorded by the normal nozzle is the size of the dot determined based on the printing data.

In this case, in the performing of the first complementary recording, at least a part of the dot missing region is complemented by the first dot that is the size of the dot determined based on the printing data. Thus, it is possible to obtain recording quality substantially same as an original recording quality to be obtained by recording if the abnormal nozzle is the normal nozzle.

It is preferable that if the detection section detects the abnormal nozzle, recording data that is generated on the premise that the second complementary recording is not performed is discarded and recording data for the first complementary recording is generated.

In this case, if the detection section detects the abnormal nozzle, the recording data generated on the premise that the second complementary recording is not performed is discarded and recording data for the first complementary recording is generated. For example, when the detection section detects the abnormal nozzle, even if the recording data generated on the premise that the second complementary recording is not performed is generated, the recording data is discarded and generation of the recording data for the first complementary recording is started. Thus, it is possible to suppress a delay of the start of the first complementary recording due to a delay of the start of generation of the recording data for the first complementary recording. Thus, it is possible to promptly start the first scanning and to perform the first complementary recording after relatively moving the medium and the recording section by the first moving amount after the scanning in which the abnormal nozzle is detected is completed.

It is preferable that in the performing of the second complementary recording, an ejecting section corresponding to the abnormal nozzle is not driven to eject the liquid.

In this case, in the performing of the second complementary recording, the ejecting section corresponding to the abnormal nozzle is not driven for ejecting the liquid. The abnormal nozzle may eject the liquid of an amount smaller than the normal amount or may eject the liquid by restoring to the normal nozzle. In this case, there is a concern that recording quality is lowered by a surplus of the dots by adding the dot due to the abnormal nozzle and the second dot for the second complementary recording. However, in the performing of the second complementary recording, since the ejecting section corresponding to the abnormal nozzle is not driven for ejecting the liquid, the liquid is not ejected from the abnormal nozzle. Thus, in the performing of the second complementary recording, it is possible to reliably suppress lowering of recording quality caused by ejecting of the liquid from the abnormal nozzle.

It is preferable that in the performing of the second complementary recording, the ejecting section corresponding to the abnormal nozzle is driven in a vibration drive mode to vibrate without ejection of the liquid, the detection section performs nozzle inspection by detecting residual vibration of the ejecting section that is driven in the vibration drive mode, and as a result of the nozzle inspection, if the abnormal nozzle is restored to the normal nozzle, the restored normal nozzle is used for recording while from the next scanning or the following the next scanning.

In this case, the ejecting section corresponding to the abnormal nozzle is driven in the vibration drive mode in which ejection of the liquid is not accompanied and the nozzle inspection is performed by the detection section in which residual vibration of the ejecting section driven in the vibration drive mode is detected. As a result of the nozzle inspection, if the abnormal nozzle is restored to the normal nozzle, the restored normal nozzle is used for recording from the next scanning or the following next scanning. Thus, it is possible to return relatively quickly to a usual recording from the performing of the second complementary recording compared to a configuration in which inspection of the abnormal nozzle is not performed in the performing of the second complementary recording. Moreover, after the abnormal nozzle is restored to the normal nozzle, the recording data using the restored normal nozzle for recording is generated. Thus, if generation of the recording data is performed in time for the next scanning or if the next scanning can be started with a small latency time even though it is not in time, recording is performed using the restored normal nozzle from the next scanning. On the other hand, if generation of the recording data is not performed in time for next scanning or if the next scanning cannot be started with a small latency time, recording is performed using the restored normal nozzle from the following next scanning.

It is preferable that if the detection section detects that the abnormal nozzle is restored to the normal nozzle in the same scanning as the scanning in which the abnormal nozzle is detected by the detection section, in the performing of the first complementary recording, a range, which includes a position in which the abnormal nozzle is initially detected in scanning before the first scanning and does not include a position in which restoring of the abnormal nozzle to the normal nozzle is detected, is set to the dot missing region.

In this case, in the scanning before the first scanning, it is detected that the abnormal nozzle is restored to the normal nozzle in the same scanning where the abnormal nozzle is detected. In this case, in first complementary recording, the first complementary recording is performed by making the range, which includes the position in which the abnormal nozzle is initially detected in scanning before the first scanning and does not include the position in which restoring of the abnormal nozzle to the normal nozzle is detected, be the dot missing region. Thus, in first complementary recording, it is possible to perform complementation of the first dot in an appropriate position with respect to the dot missing region.

It is preferable that when the recording section performs cleaning with ejection of the liquid from the nozzle between scanning and scanning, the detection section examines presence or absence of the abnormal nozzle and if the abnormal nozzle is restored to the normal nozzle from the detection result of the detection section, the performing of the second complementary recording is not performed in the next second scanning.

In this case, when the recording section performs cleaning with ejection of the liquid from the nozzle between scanning and scanning, the detection section examines the presence or absence of the abnormal nozzle. If the abnormal nozzle is restored to the normal nozzle from the detection result of the detection section, the performing of the second complementary recording is not performed in the next second scanning. Thus, it is possible to prevent the second complementary recording from being performed in the next second scanning despite the abnormal nozzle being restored to the normal nozzle by the cleaning.

It is preferable that the recording method further includes generating a plurality pieces of separation data by executing a separating process on printing data; generating halftone data by executing halftone processing on the plurality pieces of separation data; and generating the recording data for the second complementary recording for recording the second dot by the normal nozzle adjacent to the abnormal nozzle in the second scanning by stopping a recording data generating process in the recording data generating when the detection section detects the abnormal nozzle, in which in the second complementary recording, the second dot is recorded by the normal nozzle adjacent to the abnormal nozzle by performing recording by the recording section in the second scanning based on the recording data for the second complementary recording.

In this case, if the detection section detects the abnormal nozzle, the recording data generating process is stopped in the performing of the recording data generating, and in the performing of the complementary data generating, generation of the recording data for the second complementary recording is started. Thus, after the abnormal nozzle is detected, since the recording data for the second complementary recording is promptly generated, it is possible to perform the second complementary recording by promptly starting the next second scanning after the first complementary recording in the first scanning. Thus, even if the first complementary recording is performed, it is possible to suppress lowering of the throughput of recording.

It is preferable that the recording data for the second complementary recording is reconstructed by using the halftone data generated by the halftone processing for the next scanning of the scanning in which the abnormal nozzle is detected.

In this case, the recording data for the second complementary recording is reconstructed by using the halftone data generated by the performing of the halftone processing for the next scanning of the scanning in which the abnormal nozzle is detected. Thus, since the generated halftone data is used, it is possible to reconstruct the recording data for the second complementary recording at a relatively short time without retrying the halftone processing. As a result, it is possible to suppress a delay of the start of the second complementary recording and even if the first complementary recording is performed, it is possible to suppress lowering of the throughput of recording.

According to another aspect of the invention, there is provided a recording apparatus that performs recording on a medium by forming dots by ejecting a liquid from nozzles during scanning in which a recording section having a nozzle column formed of a plurality of nozzles is moved in a scanning direction intersecting the nozzle column, the recording apparatus including: a recording section that forms the dots by ejecting the liquid from the nozzles during scanning in which the recording section is moved in the scanning direction; a detection section that is capable of detecting an abnormal nozzle at least during scanning of the recording section; a moving section that relatively moves the recording section and the medium; and a control section that controls the recording section and the moving section, in which the control section performs first complementary recording and second complementary recording, in which in the first complementary recording, if the detection section detects the abnormal nozzle, a normal nozzle that is not detected as the abnormal nozzle by the detection section is disposed in a row where dot missing is generated by the abnormal nozzle by relatively moving the medium and the recording section by a first moving amount that is shorter than a defined moving amount to the next scanning position in a case where the abnormal nozzle is not detected before a first scanning that is the next scanning, and at least a part of a dot missing region is complemented by a first dot formed by the normal nozzle in the first scanning, and in which in the second complementary recording, the medium and the recording section are relatively moved by controlling the moving section by a second moving amount remaining until the defined moving amount if the abnormal nozzle is detected before second scanning that is the next scanning of the first scanning, and thereby in the second scanning, a second dot having a size greater than a size of a dot that is determined based on printing data is recorded by the normal nozzle positioned adjacent to the abnormal nozzle in a nozzle column direction of the abnormal nozzle.

BRIEF DESCRIPTION OF THE DRAWINGS

The invention will be described with reference to the accompanying drawings, wherein like numbers reference like elements.

FIG. 16A is a block diagram illustrating a flow of pass data generation processing in ejection normality and FIG. 16B is a block diagram illustrating a flow of pass data generation processing in ejection abnormality.

DESCRIPTION OF EXEMPLARY EMBODIMENTS

Hereinafter, an embodiment of an ink jet type printer that is an example of a recording apparatus will be described with reference to the drawings.

Figure 1:
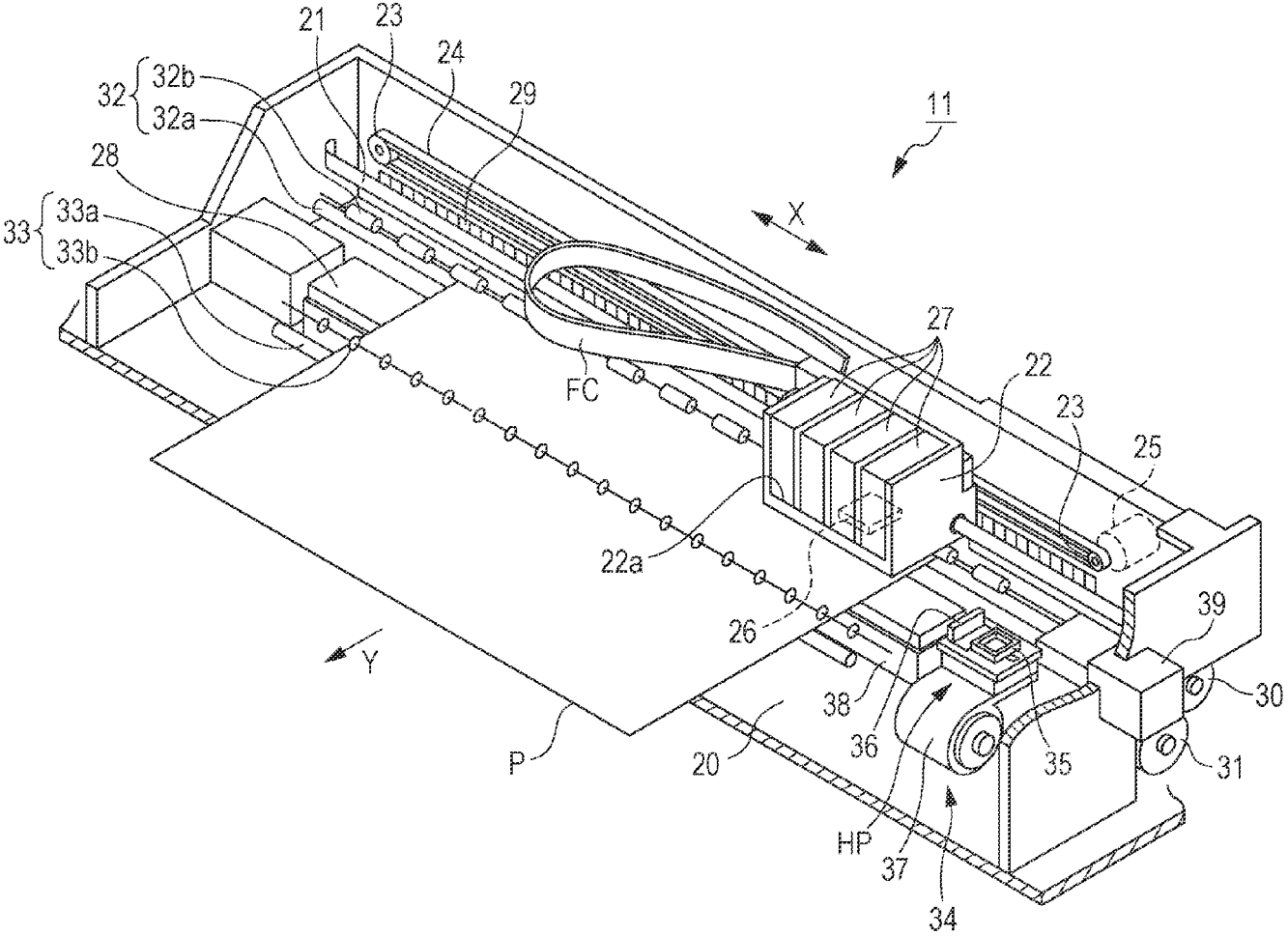
FIG. 1 is a perspective view of a printer in a state where an external housing is removed in a first embodiment.

A printer 11 illustrated in FIG. 1 is an ink jet type serial printer. In FIG. 1, the printer 11 is in a state where an external housing is removed and has a substantially rectangular box-shaped body frame 20 of which an upper side and a front side are opened. A guide shaft 21 having a predetermined length is laid between right and left side walls of the body frame 20 in FIG. 1, and a carriage 22 is guided along the guide shaft 21 in a scanning direction X (main scanning direction) to be reciprocated. The carriage 22 is fixed to a part of an endless timing belt 24 wound around a pair of pulleys 23 and 23 mounted on the inside of a rear plate of the body frame 20. The pulley 23 on the right side in FIG. 1 is a driving pulley mounted on a driving shaft of a carriage motor 25, the carriage motor 25 is driven forward and backward, and thereby the timing belt 24 is rotated forward and backward. Thus, the carriage 22 reciprocates in the scanning direction X.

As illustrated in FIG. 1, a recording head 26 is provided at a lower portion of the carriage 22 as an example of a recording section. Furthermore, ink cartridges 27 as an example of a plurality (four in the example of FIG. 1) of liquid supply sources are mounted on a cartridge holder 22*a* that is recessed at an upper portion of the carriage 22. As an example of a liquid, for example, ink of a plurality of colors (four colors in the example of FIG. 1) including black (K), cyan (C), magenta (M), and yellow (Y) is accommodated in each of the ink cartridges 27. Of course, the number of colors of ink is not limited and may be one color (black as an example), two colors, three colors, or five to eight colors. In this case, the mounting number of the ink cartridges 27 can be any number corresponding to the number of ink colors of one to eight. Furthermore, a configuration may be provided in which ink of a plurality of colors (three colors as an example) is accommodated in each chamber that is divided by partition walls in one ink cartridge 27. Moreover, a mounting system of the ink cartridges 27 may be changed to a so-called on-carriage type for mounting the ink cartridges on the carriage 22 or may be a so-called off-carriage type for mounting the ink cartridges on a cartridge holder on the body frame 20 side. Furthermore, the liquid supply source is not limited to the ink cartridge and, for example, may be an ink replenishment-type ink tank mounted on a side surface of the external housing of the printer 11 and the like.

The recording head 26 ejects ink supplied from each of the ink cartridges 27 from each of nozzles 26*b* (all refer to FIG. 2) that are opened to a nozzle opening surface 26*a* that is a surface on a side facing a recording medium P (hereinafter, simply referred to as "medium P") such as a sheet. The recording head 26 is connected to be communicable to a control section 51 (controller) (see FIG. 5) provided inside the printer 11 through a flexible flat cable FC connected to the carriage 22. Then, the recording head 26 is driven based on pass data that is an example of recording data for printing in one scanning (one pass) of the carriage 22, which is sequentially transferred from the control section 51.

As illustrated in FIG. 1, an elongated support stand 28, which supplies the medium P and defines an interval (gap) between the recording head 26 and the medium P, is disposed in a lower position of the recording head 26 facing a moving region (scanning region) of the recording head 26 in a state of extending in the scanning direction X. The support stand 28 extends in the scanning direction X over at least a region slightly wider than an entire region of a printing region where printing is performed by the recording head 26. Ink droplets ejected from each nozzle 26*b* of the recording head 26 land and dots are formed on portions of the medium P, which are supported by an upper surface (support surface) of the support stand 28 during printing. Thus, a document, an image, and the like are printed on the medium P.

Furthermore, a linear encoder 29 outputting a detection signal (encoder pulse signal) including the number of pulses proportional to a moving amount of the carriage 22 is provided on a rear surface side of the carriage 22 so as to extend along the guide shaft 21. The printer 11 grasps a position and a speed (the number of pulses for unit time) of the carriage 22 in the scanning direction X by counting the number of pulse edges of the detection signal of the linear encoder 29, and performs position control and speed control of the carriage 22 based on information of the position and the speed.

Furthermore, a feed motor 30 and a transport motor 31 are disposed at a lower portion of the body frame 20 on the right side in FIG. 1. The feed motor 30 drives a feed roller (not illustrated) (for example, a pick-up roller) abutting surfaces of a plurality of media P accommodated within a cassette (not illustrated) and feeds the medium P one by one from the top medium. Furthermore, the feed motor 30 allows a hopper (not illustrated) on which the plurality of media P are mounted to tilt, allows the feed roller (not illustrated) to abut the surfaces of the plurality of media on the hopper, and in this state, drives the feed roller, thereby feeding the medium P one by one from the top medium. The fed medium P is delivered until a tip end portion thereof reaches a pair of transport rollers 32.

As illustrated in FIG. 1, the pair of transport rollers 32 and a pair of discharge rollers 33, of which a power source is the transport motor 31, are respectively disposed at each position on an upstream side and a downstream side in a transport direction Y with the support stand 28 interposed therebetween. The pair of transport rollers 32 are configured of a transport driving roller 32*a* that is driven to be rotated by power of the transport motor 31 and a transport driven roller 32*b* that is rotated by abutting the transport driving roller 32*a*. Furthermore, the pair of the discharge rollers 33 are configured of a discharge driving roller 33*a* that is driven to be rotated by power of the transport motor 31 and a discharge driven roller 33*b* that is rotated by abutting the discharge driving roller 33*a*. The transport motor 31 is driven to be rotated and thereby the transport driving roller 32*a* and the discharge driving roller 33*a* are driven. Thus, the fed medium P is transported in the transport direction Y in a state of being nipped by both pairs of the rollers 32 and 33.

The serial type printer 11 illustrated in FIG. 1 performs printing of the document, the image, and the like on the medium P by alternately repeating a printing operation, in which ink is ejected from the nozzles 26*b* (see FIG. 2) of the recording head 26 to the medium P while the carriage 22 reciprocates in the scanning direction X, and a feeding operation in which the medium P is transported to the next scanning position (printing position) with a defined transport amount in the transport direction Y.

The printer 11 of the embodiment is a large size-type printing apparatus which can transport and print the medium P of a large size. Thus, if a certain print quality is not satisfied due to the occurrence of a white streak and the like on a print image caused by ejection abnormality such as clogging of the nozzle of the recording head 26, a printed matter fails and the medium P and ink used for printing are wasted. Thus, the printer 11 of the embodiment employs a printing method in which a white streak and the like causing a lowering of print quality is reduced or is made inconspicuous.

One end position (right end position in FIG. 1) on a moving path of the carriage 22 in FIG. 1 is a home position HP in which the carriage 22 is in standby during non-printing. A maintenance device 34 for performing maintenance such as cleaning with respect to the recording head 26 is disposed at a position immediately below the carriage 22 in the home position HP. The maintenance device 34 includes a cap 35, a wiper 36, a suction pump 37, and the like. The maintenance device 34 drives the suction pump 37 and performs cleaning for forcedly sucking and discharging ink from the nozzles 26*b* of the recording head 26 in a state where the cap 35 abuts the nozzle opening surface 26*a* (see FIG. 2) that is a surface on a side facing the support stand (that is, the medium P) of the recording head 26 disposed at the home position HP. Waste ink that is sucked and discharged during cleaning is discharged from the maintenance device 34 to a waste liquid tank 38 on a lower side of the support stand 28. Moreover, in the embodiment, the transport motor 31 also serves as a power source of the suction pump 37. The carriage 22 operates a switching lever (not illustrated) in the process of reaching the home position HP and thereby a power transmission path of a power transmission switching mechanism 39 disposed in the vicinity of the home position is switched to the suction pump 37 side. Of course, the suction pump 37 may be driven by the power of a dedicated electric motor.

Furthermore, the carriage 22 performs flushing (blank ejecting) to eject the ink droplets that are not related to the printing from all nozzles of the recording head 26 to the cap 35 by moving to the home position HP regularly or irregularly during printing. Ink within an unused nozzle from which the ink droplets are not ejected during printing gradually thickens over time and causes clogging of the nozzle. Thus, whenever an elapsed time from a previous flushing implementation time reaches a set time during printing, if the carriage 22 completes the scanning at that time, the carriage 22 is moved to the home position HP between scanning and scanning and flushing is implemented.

Figure 2:
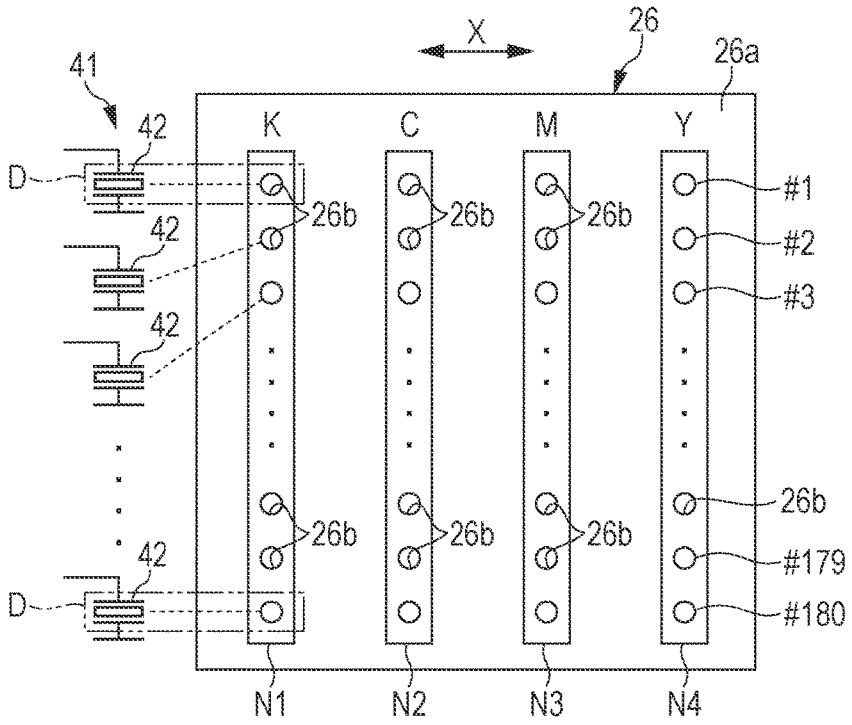
FIG. 2 is a schematic view illustrating a bottom surface of a recording head and an ejection drive element.

As illustrated in FIG. 2, a plurality of columns (for example, four columns) of nozzle columns N1 to N4 corresponding to a plurality of colors (for example, four colors) of ink respectively configured of the nozzles 26*b* of a total 180 of #1 to #180 arranged in one column at a constant nozzle pitch in the transport direction Y are formed in the nozzle opening surface 26*a* of the recording head 26. In this example, printing is performed with four colors of black (K), cyan (C), magenta (M), and yellow (Y) using a total of four columns of the nozzle columns N1 to N4. Moreover, arrangement of each of the nozzles 26*b* configuring the nozzle column is not limited to the linear arrangement at the constant pitch and may be two columns of a zigzag arrangement at a constant pitch shifted by half a pitch from each other.

Furthermore, as illustrated in FIG. 2, ejection drive elements 42 corresponding to 180 nozzles 26*b* of #1 to #180 are built into the recording head 26 with the same number as the number of nozzles for each nozzle column. Then, an ejection drive element group 41 is configured of a plurality (for example, 720) of ejection drive elements 42 as many as the number of nozzles. Moreover, in FIG. 2, only the ejection drive elements 42 corresponding to 180 nozzles 26*b* of #1 to #180 configuring the nozzle column N1 are schematically drawn on the outside of the recording head 26. The ejection drive element 42 is, for example, formed of a piezoelectric vibrator or an electrostatic drive element. The ejection drive element 42 is configured such that if a driving pulse (voltage pulse) having a predetermined driving waveform is applied, a vibration plate 265 configuring a part of wall portions defining a cavity 264 communicating with the nozzle 26*b* (all refer to FIG. 3) is vibrated by an electrostriction action or an electrostatic drive action, the cavity 264 is expanded and contracted, and thereby the ink droplets are ejected from the nozzle 26*b*. As the ejection drive element 42, in addition to the piezoelectric element (piezo element) and the electrostatic drive element, a heater element in which the ink droplets are ejected from the nozzle using a pressure of the air bubble generated by film boiling by heating ink and the like are exemplified. As described above, the ejection drive system, in which the ink droplets are ejected from the nozzle 26*b* of the recording head 26, may employ one of a piezoelectric drive system, an electrostatic drive system, and a heating drive system.

Figure 3:
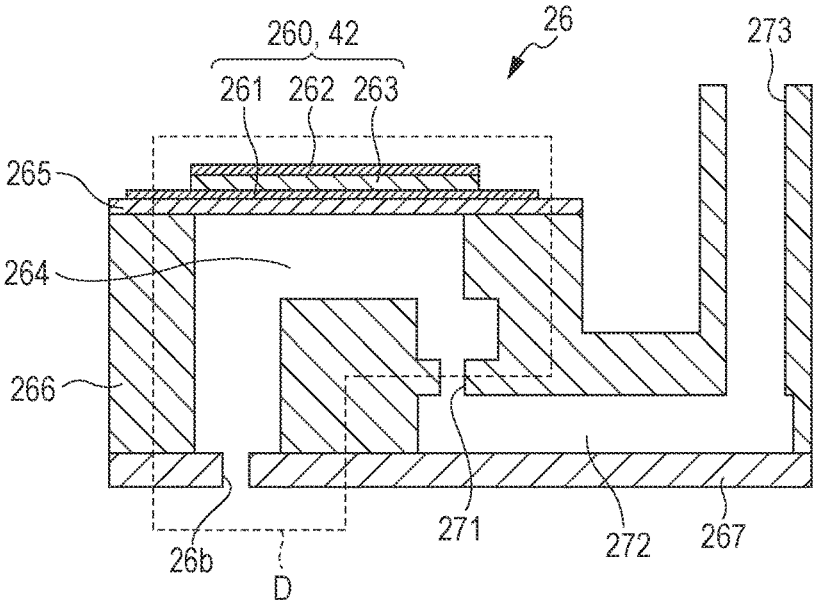
FIG. 3 is a sectional view illustrating a configuration of an ejecting section.

Next, a configuration of an ejecting section D ejecting the ink droplets from the nozzle 26*b* of the recording head 26 will be described with reference to FIG. 3. FIG. 3 illustrates one ejecting section D of the ejecting sections D of the same number as the plurality of nozzles 26*b* provided in the recording head 26, a reservoir 272 communicating with one ejecting section D through an ink supply port 271, and an ink supply flow path 273 for supplying ink from the ink cartridge 27 to the reservoir 272.

As illustrated in FIG. 3, the ejecting section D includes a piezoelectric element 260 that is an example of the ejection drive element 42, the cavity 264 (ink chamber) of which an inside is filled with ink, the nozzle 26*b* communicating with the cavity 264, and the vibration plate 265. The piezoelectric element 260 is driven by a driving signal Vin and thereby the ejecting section D ejects ink within the cavity 264 from the nozzle 26*b*.

The cavity 264 of the ejecting section D is a space defined by a cavity plate 266 formed in a predetermined shape having a concave section, a nozzle plate 267 in which the nozzle 26*b* is formed, and the vibration plate 265. The cavity 264 communicates with the reservoir 272 through the ink supply port 271. The reservoir 272 communicates with one ink cartridge 27 through the ink supply flow path 273.

In the embodiment, as the piezoelectric element 260, for example, a unimorph (monomorph) type is employed as illustrated in FIG. 3. The piezoelectric element 260 has a lower electrode 261, and an upper electrode 262, and a piezoelectric substance 263 provided between the lower electrode 261 and the upper electrode 262. Then, the lower electrode 261 is set to be a predetermined reference potential Vss, the driving signal Vin is supplied to the upper electrode 262, and if a voltage is applied between the lower electrode 261 and the upper electrode 262, the piezoelectric element 260 is bent and vibrates in a vertical direction in FIG. 3.

The lower electrode 261 of the piezoelectric element 260 is connected to the vibration plate 265 disposed in a state where an upper surface opening section of the cavity plate 266 is closed. Thus, if the piezoelectric element 260 is vibrated by the driving signal Vin, the vibration plate 265 also vibrates. Then, a volume (pressure within the cavity 264) of the cavity 264 is changed by the vibration of the vibration plate 265 and ink with which the inside of the cavity 264 is filled is ejected from the nozzle 26*b*.

If ink within the cavity 264 is reduced by ejection of ink, ink is supplied from the reservoir 272 to the cavity 264. Furthermore, ink is supplied from the ink cartridge 27 to the reservoir 272 through the ink supply flow path 273.

Next, an ink ejecting operation of the ejecting section D will be described with reference to FIGS. 4A to 4C. In a state of being illustrated in FIG. 4A, if the driving signal Vin is supplied from a head driving circuit 65 (all refer to FIG. 5) to the piezoelectric element 260 (see FIG. 3) included in the ejecting section D, distortion occurs in the piezoelectric element 260 in response to an electric field applied between electrodes and the vibration plate 265 of the ejecting section D is bent upward in FIG. 4B. As illustrated in FIG. 4B, the volume of the cavity 264 of the ejecting section D is increased compared to an initial state illustrated in FIG. 4A. In the state being illustrated in FIG. 4B, if a potential indicating the driving signal Vin is changed, the vibration plate 265 is restored by an elastic restoring force. As illustrated in FIG. 4C, the vibration plate 265 moves downward in the same view beyond the position of the vibration plate 265 in the initial state and the volume of the cavity 264 is rapidly contracted. In this case, some of ink with which the cavity 264 is filled is ejected as the ink droplets from the nozzle 26*b* communicating with the cavity 264 by a compression pressure generated within the cavity 264.

Figure 5:
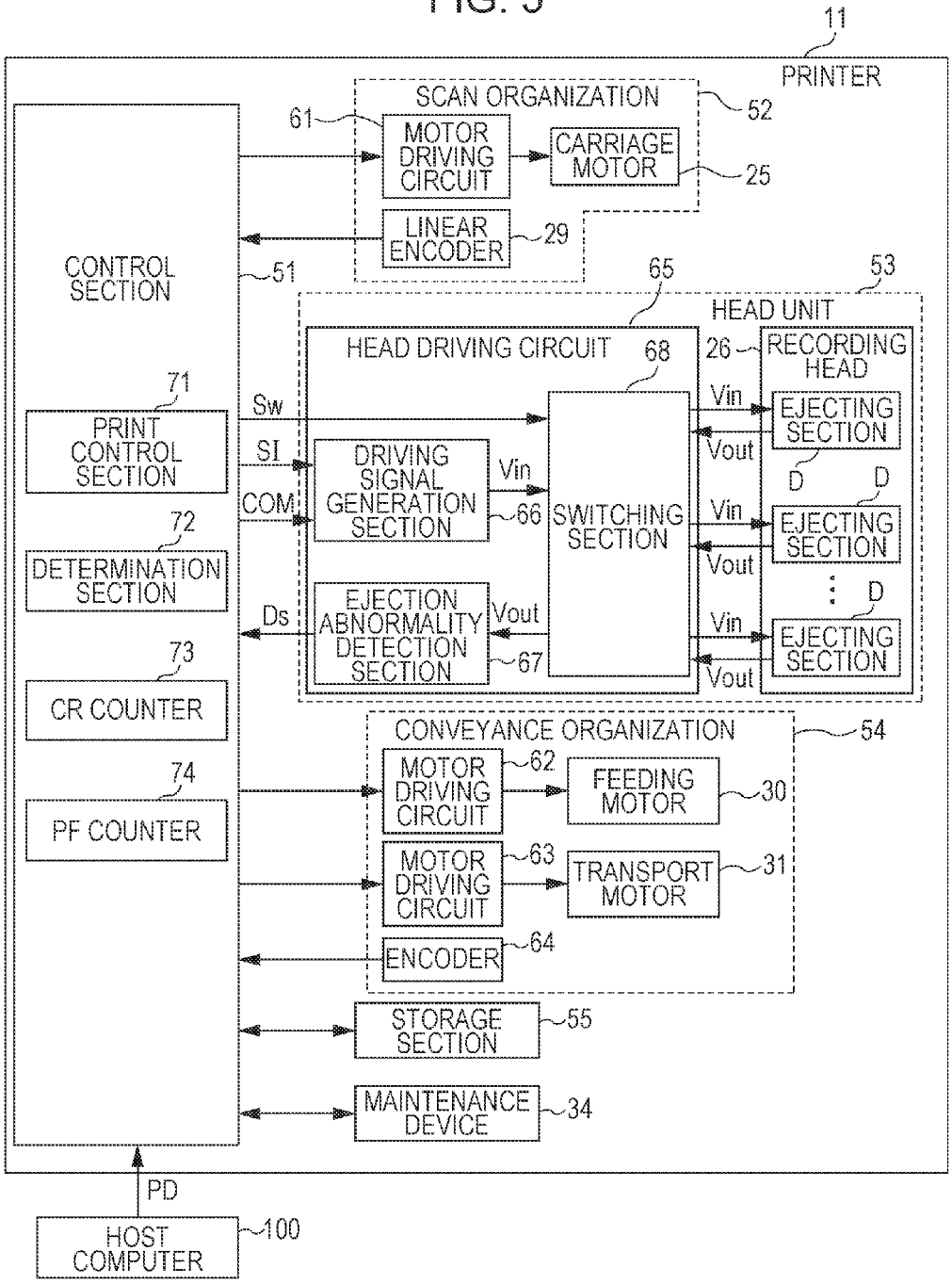
FIG. 5 is a block diagram illustrating an electrical configuration of the printer.

Next, an electrical configuration of the printer 11 will be described with reference to FIG. 5. As illustrated in FIG. 5, the printer 11 includes the control section 51, a scanning mechanism 52 that moves the carriage 22 having the recording head 26 in the scanning direction X, a head unit 53 that has the plurality of ejecting sections D ejecting ink, and a transport mechanism 54 as an example of a moving section performing feed and transport of the medium P in the transport direction Y. Furthermore, the printer 11 includes the maintenance device 34 performing maintenance for normally restoring the ejection state of ink of the ejecting section D if ejection abnormality of the ejecting section D is detected. Furthermore, the printer 11 includes the control section 51 performing print control by controlling of various motors 25, 30, and 31, the ejecting section D, and the like, maintenance control by controlling of the maintenance device 34, and the nozzle inspection for detecting ejection abnormality of the nozzle 26*b* of the ejecting section D. Furthermore, the printer 11 includes a storage section 55 for storing a control program of the printer 11 and various pieces of information.

As illustrated in FIG. 5, the scanning mechanism 52 includes the carriage motor 25 that is a power source moving the carriage 22 in the scanning direction X, a motor driving circuit 61 that drives the carriage motor 25, and the linear encoder 29 that outputs a detection signal (encoder pulse signal) including the number of pulses proportional to a moving amount of the carriage 22 in the scanning direction X.

As illustrated in FIG. 5, the transport mechanism 54 includes the feed motor 30 that is a power source for feeding the medium P, a motor driving circuit 62 that moves the feed motor 30, the transport motor 31 that is a power source for transporting the medium P, and a motor driving circuit 63 that drives the transport motor 31. Furthermore, the transport mechanism 54 includes an encoder 64 that outputs the detection signal (encoder pulse signal) including the number of pulses proportional to the transport amount of the medium P. Furthermore, as illustrated in FIG. 1, the transport mechanism 54 includes the support stand 28 that supports the transported medium P on the lower side of a moving path of the recording head 26, the pair of transport rollers 32, and the pair of discharge rollers 33 that are rotated by power of the transport motor 31.

The storage section 55 is configured of a Random Access Memory (RAM) that temporarily stores printing data PD received by the printer 11 from a host computer 100 and data that is necessary when executing various processes such as printing process, or temporarily develops a control program for executing various processes such as the printing process, and an non-volatile memory that stores the control program for controlling each section of the printer 11 and the like.

The control section 51 is configured to include a computer having a Central Processing Unit (CPU), a field-programmable gate array (FPGA), and the like. The control section 51 controls an operation of each section of the printer 11 by the computer operating according to the control program stored in the storage section 55.

Specifically, the control section 51 includes a print control section 71 that is responsible for various controls related to printing, the determination section 72 that performs an ejection state determination process, a position counter 73 (hereinafter, also referred to as "CR counter") for the carriage for counting the position of the carriage 22 in the scanning direction X, and a position counter 74 (hereinafter, also referred to as "PF counter") for transporting for counting the position of the medium P in the transport direction Y.

The print control section 71 performs printing control for forming an image on the medium P according to printing data by controlling the head unit 53 and the transport mechanism 54 based on the printing data from the host computer 100.

More specifically, first, the print control section 71 stores the printing data PD and the like from the host computer 100 in the storage section 55. Next, the print control section 71 controls the head unit 53 based on the printing data PD stored in the storage section 55 or a received signal, generates pass data SI as an example of the recording data for driving the ejecting section D or a signal for controlling the head driving circuit 65, and outputs the generated data or various signals.

Such a print control section 71 drives the carriage motor 25 such that the carriage 22 reciprocates through control of the motor driving circuit 61 in the scanning direction X together with the recording head 26. Furthermore, the print control section 71 controls presence or absence of ejection of ink from the ejecting section D, the ejecting amount of ink, ejection timing of ink, and the like through control of the head unit 53. Thus, the control section 51 adjusts a size and a position of the dot formed by ink ejected on the medium P according to the printing data PD, and performs control of printing of the image corresponding to the printing data PD on the medium P.

As illustrated in FIG. 5, the head unit 53 includes the recording head 26 having the plurality of ejecting sections D and the head driving circuit 65 having a function one ejecting section D driving each ejecting section D and a function of detecting ejection abnormality of the nozzle 26*b* of each ejecting section D. The head driving circuit 65 includes a driving signal generation section 66, an ejection abnormality detection section 67 as an example of the detection section, and a switching section 68.

The driving signal generation section 66 generates the driving signal Vin for respectively driving the plurality of ejecting sections D having the recording head 26 based on control signal such as the pass data SI, a drive waveform signal COM, and the like supplied from the print control section 71. Each ejecting section D is driven based on the supplied driving signal Vin and can eject ink with which the inside thereof is filled from the nozzle 26*b* onto the medium P. Here, the pass data SI is dot data in which one dot is indicated as two bits. As an example, four gradations are represented in which if a pixel value is "11", it is a large dot, if the pixel value is "10", it is a medium dot, if the pixel value is "01", it is a small dot, and if the pixel value is "00", it is not ejected. Furthermore, the drive waveform signal COM includes a plurality of waveforms (for example, trapezoidal waveform) and the driving signal generation section 66 respectively selects a waveform for the large dot if the pixel value is "11", a waveform for the medium dot if the pixel value is "10", a waveform for the small dot if the pixel value is "01", and a waveform for fine vibration when no ejection if the pixel value is "00".

The ejection abnormality detection section 67 inputs a residual vibration signal Vout that is output by the piezoelectric element 260 receiving vibration, in which a change in a pressure caused by residual vibration and the like of ink inside the ejecting section D is transmitted to the vibration plate 265, which is generated after the ejecting section D is driven by the driving signal Vin. The ejection abnormality detection section 67 detects whether the nozzle 26*b* of the ejecting section D of an inspection target is a normal nozzle capable of normal ejecting the ink droplets or is an abnormal nozzle that is in the ejection abnormality in which the ink droplets are not normally ejected based on the input residual vibration signal Vout. A detection result is output to the control section 51 as a detection signal Ds. If the detection result is determined as the abnormal nozzle, the detection signals Ds for a plurality of causes are output.

A determination section 72 within the control section 51 determines whether the nozzle 26*b* of the ejecting section D of the inspection target is the normal nozzle or the abnormal nozzle based on the detection signal Ds. If the determination section 72 determines that it is the abnormal nozzle, nozzle position information NP capable of specifying the position of the abnormal nozzle and information of an ejection abnormality detection start position Xst in the scanning direction X obtained from a counting value of a CR counter 73 of an ejection abnormality detection start time are obtained. The nozzle position information NP includes a nozzle column number capable of specifying the nozzle column of the plurality of nozzle columns and the nozzle number capable of specifying one nozzle of the nozzle column specified by the nozzle column number.

The switching section 68 electrically connects each ejecting section D to one of the driving signal generation section 66 and the ejection abnormality detection section 67 based on a switching control signal Sw supplied from the print control section 71. That is, the switching section 68 is switched between a first connection state in which the ejecting section D is electrically connected to the driving signal generation section 66 and a second connection state in which the ejecting section D is electrically connected to the ejection abnormality detection section 67. The print control section 71 outputs the switching control signal Sw for controlling the connection state of the switching section 68 to the switching section 68. Specifically, the print control section 71 supplies the switching control signal Sw indicating that the switching section 68 continues the first connection state to the switching section 68 in a unit ejecting operation period in which an ejecting process is executed. Thus, the driving signal Vin is supplied from the driving signal generation section 66 to the ejecting section D in the unit ejecting operation period.

Furthermore, the print control section 71 is in the second connection state in a unit inspection period in which the nozzle inspection is executed when the recording head 26 is in an inspection position in which the nozzle inspection of the ejecting section D is performed. The ejecting operation of the ink droplets for one dot based on application of the driving signal Vin to the ejection drive element 42 (the piezoelectric element 260) of the ejecting section D and obtaining of the residual vibration signal Vout output by the ejection drive element 42 to which residual vibration is transmitted according to the ejecting operation of the ink droplets for one dot are performed in unit period that is a sum of the unit ejecting operation period and the unit inspection period.

The ejection abnormality detection section 67 illustrated in FIG. 5 detects whether the nozzle is the normal nozzle or the abnormal nozzle using waveform information including at least a period of the period and an amplitude of residual vibration of an ejecting section Dj (where, j=1, 2, . . . , K) of the inspection target based on the residual vibration signal Vout. If the nozzle is the abnormal nozzle, the ejection abnormality detection section 67 detects the abnormal nozzle by the causes (mixing of air bubble, drying, and attaching of paper dust). Then, the ejection abnormality detection section 67 outputs the detection result as the detection signal Ds. Specifically, the ejection abnormality detection section 67 includes a waveform shaping section that generates a shaped waveform signal that is obtained by removing a noise component from the residual vibration signal Vout output from the ejecting section D and a measurement section that outputs the detection signal Ds based on the shaped waveform signal. The waveform shaping section is configured to include a function of adjusting the amplitude of the residual vibration signal Vout, a function of converting to the residual vibration signal Vout of low impedance, and the like in addition to the function of removing the noise. The measurement section compares at least the period of the period and the amplitude of the shaped waveform signal output by the waveform shaping section to a plurality of thresholds, detects whether the nozzle is the normal nozzle or the abnormal nozzle and if nozzle is the abnormal nozzle, detects the abnormal nozzle by the causes, and outputs the detection result as the detection signal Ds.

The determination section 72 determines whether the nozzle 26*b* of the ejecting section Dj of the inspection target is the normal nozzle Nn or the abnormal nozzle Na based on the detection signal Ds from the ejection abnormality detection section 67, and if the nozzle 26*b* is the abnormal nozzle Na, determines the abnormal nozzle Na by the causes.

The vibration plate 265 of each ejecting section D is damping-vibrated (residual vibration) until the next ink ejecting operation is started after a series of the ink ejecting operation is completed. It can be assumed that the residual vibration generated in the vibration plate 265 of the ejecting section D has a natural vibration frequency that is determined by an acoustic resistance Rs by a shape of the nozzle 26*b* or the ink supply port 271, viscosity of ink, and the like, an inertance Int by a weight of ink within the flow path, and compliance Cm of the vibration plate 265.

Figure 6:
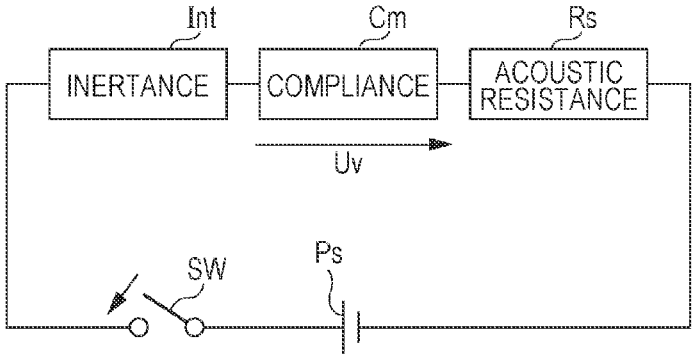
FIG. 6 is a circuit diagram illustrating an equivalent circuit of an ejection abnormality detection section.

FIG. 6 is a circuit diagram illustrating a calculation model of simple harmonic vibration assuming the residual vibration of the vibration plate 265 based on the above assumptions. The calculation model of the residual vibration of the vibration plate 265 is indicated by a sound pressure Ps, the inertance Int, the compliance Cm, and the acoustic resistance Rs. Then, if step response when giving the sound pressure Ps to the circuit of FIG. 6 is calculated for a volume speed Uv, the following expressions are obtained.

$$Uv=\{Ps/(\omega\cdot Int)\})e^{-\omega t}\cdot\sin \mu t$$

$$\omega=\{1/(Int\cdot Cm)-\alpha^2\}^{1/2}$$

$$\alpha=Rs/(2\cdot Int)$$

An experiment of residual vibration of the ejecting section D was performed. The experiment is an experiment for detecting the residual vibration generated in the vibration plate 265 of the ejecting section D after ink is ejected from the ejecting section D in which an ejection state of ink is normal.

Figure 4A:
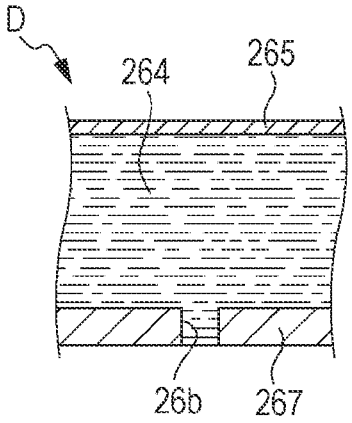
FIGS. 4A to 4C are schematic partial sectional views illustrating an ejecting operation of the ejecting section.
Figure 4B:
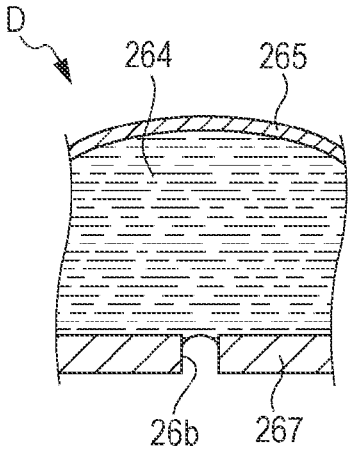
Figure 4C:
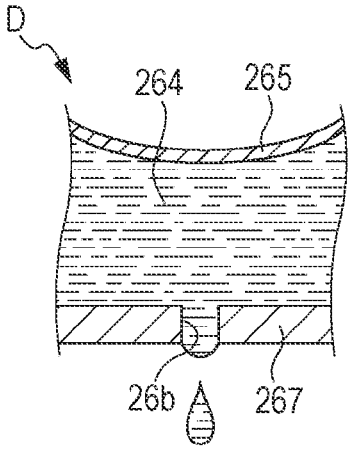

Here, if the ejecting section D illustrated in FIGS. 4A to 4C normally ejects ink, and there is no change in the acoustic resistance Rs, the inertance Int, and the compliance Cm, the residual vibration of the vibration plate 265 becomes a predetermined waveform (see "normal L0" of FIG. 7) in normality. However, if dot missing occurs due to failure of ink ejection, the waveform of the residual vibration of the vibration plate 265 is different from that in the normality.

Figure 7:
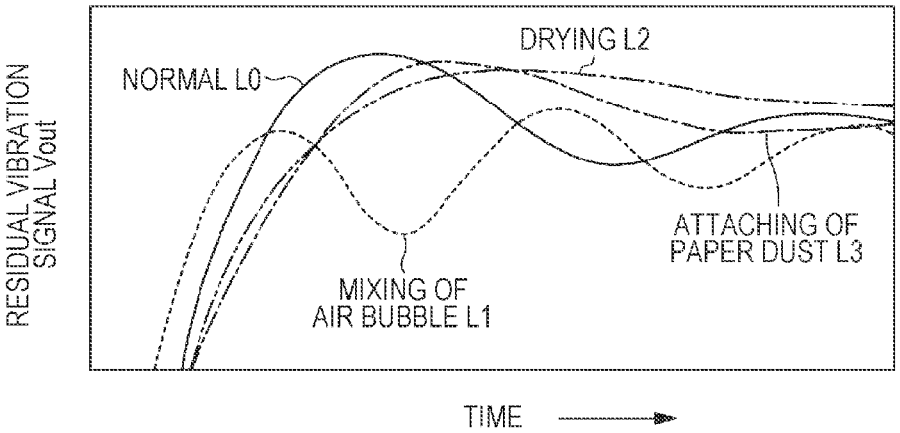
FIG. 7 is a graph illustrating a detection waveform in the ejection abnormality detection section.

FIG. 7 is a graph illustrating an example of an experimental value of the residual vibration. Now, if the ejecting section D normally performs the ink ejecting operation, the acoustic resistance Rs, the inertance Int, and the compliance Cm take the values in normality, and the waveform of the residual vibration of the vibration plate 265 becomes a predetermined waveform (see "normal L0" of FIG. 7) in normality. However, despite the fact that the ejecting section D performs the ink ejecting operation, an ejection state of ink is abnormal in the ejecting section D and ejection abnormality (ejection failure), in which the ink droplets from the nozzle 26*b* of the ejecting section D are not ejected normally, may occur. As the causes of occurrence of the ejection abnormality, (a) air bubble is mixed into the cavity, (b) thickening or fixing of ink caused by drying of ink within the nozzle 26*b* and the cavity 264, (c) a foreign matter such as paper dust is attached the vicinity of the outlet of the nozzle 26*b*, and the like are exemplified.

Detailed description by causes of occurrence of ejection abnormality of (a) to (c) described above will be described with reference to FIGS. 7 to 8C.

Figure 8A:
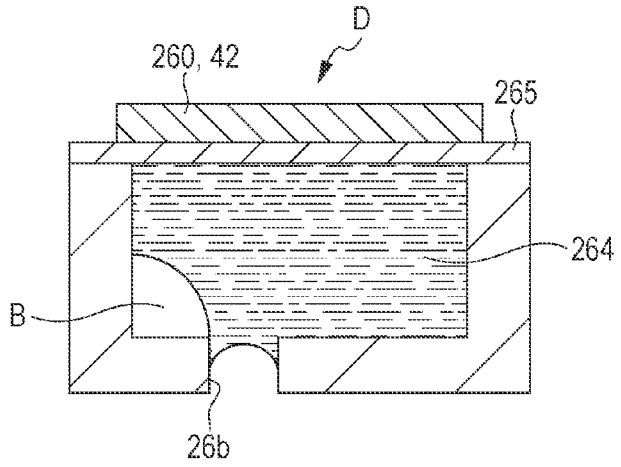
FIGS. 8*a* to 8C are schematic partial sectional views of a recording head illustrating an abnormal nozzle classified by causes.

As illustrated in FIG. 8A, if an air bubble B clogs the flow path (for example, the cavity 264) of ink or a tip end of the nozzle 26*b*, the weight of ink is decreased by an amount of mixed air bubble B, the inertance Int is reduced, and a nozzle diameter becomes a state equivalent to be increased by the air bubble B. Thus, in ejection abnormality caused by the air bubble, the acoustic resistance Rs is decreased, and the frequency can be detected as characteristic waveform of the residual vibration (see "mixing of air bubble L1" of FIG. 7).

Figure 8B:
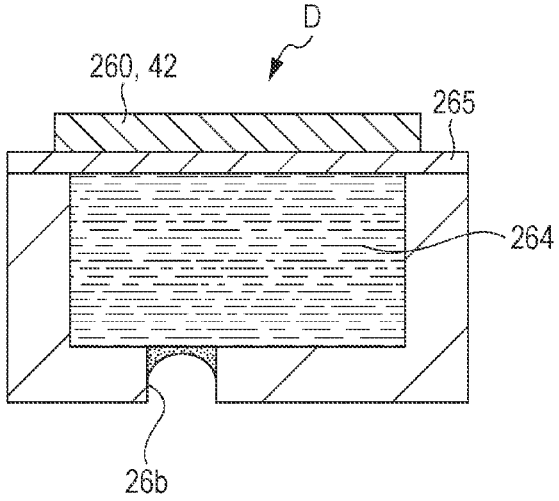

As illustrated in FIG. 8B, ink is not ejected by thickening or fixing of ink due to drying of ink on the inside of the nozzle 26*b*, the viscosity of ink in the vicinity of the nozzle 26*b* by drying is increased, the acoustic resistance Rs is increased, and characteristic waveform of the residual vibration can be detected as overdamping (see "drying L2" of FIG. 7).

Figure 8C:
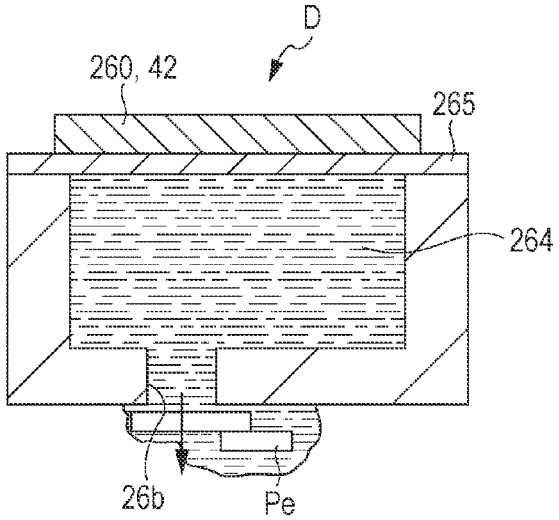

As illustrated in FIG. 8C, if paper dust Pe (paper fiber and the like) or dust is attached to the nozzle opening surface 26*a*, ink flows over from the nozzle 26*b* due to the paper dust Pe and thereby the weight of ink viewed from the vibration plate 265 is increased and the inertance Int is increased. Furthermore, the acoustic resistance Rs is increased by fiber of the paper dust Pe attached to the nozzle 26*b* and a characteristic waveform of the residual vibration, in which the period is increased (frequency is decreased) compared to a case of normal ejecting, can be detected (see "attaching of paper dust L3" of FIG. 7).

As described above, it is possible to detect ejection abnormality of the ink droplets of the recording head 26 and to specify the cause of clogging by a difference in the residual vibration of the vibration plate 265. Thus, in the example, the ejection abnormality detection section 67 within the head driving circuit 65 illustrated in FIG. 5 detects the residual vibration signal Vout based on the driving signal Vin. The ejection abnormality detection section 67 detects ejection abnormality (abnormal nozzle) of the ink droplets from the nozzle 26*b* of the recording head 26 by detecting the residual vibration of such a vibration plate 265. The ejection abnormality detection section 67 detects at least the magnitude of the period of the period and the amplitude of the residual vibration illustrated in FIG. 7 and detects whether the normal ejection is in ejection abnormality due to air bubble, drying, and paper dust by using a plurality of thresholds capable of distinguishing the residual vibration by the causes. The detection signal Ds of the ejection abnormality detection section 67 is output to the determination section 72. The determination section 72 determines whether the ejection state of each ejecting section D of the inspection target is normal or abnormal (air bubble, drying, and paper dust) based on the detection signal Ds of the ejection abnormality detection section 67. If the determination section 72 initially determines that the ejection state is abnormal in the pass indicating movement of the recording head 26 one time in the scanning direction X, the nozzle position information NP specifying the position of the ejecting section D (that is, the nozzle 26*b*) of ejection abnormality and the ejection abnormality detection start position Xst (see FIG. 11) indicating the position in which ejection abnormality is caused in the scanning direction X are written into the storage section 55. Furthermore, in the storage section 55, a flag storing for storing information whether ejection is normal or abnormal for each nozzle is prepared in the storage section 55 and when ejection abnormality occurs, a flag corresponding to the abnormal nozzle is set and thereby effect of occurrence of ejection abnormality is written. Moreover, hereinafter, "ejection abnormality detection start position Xst" is also referred to as "dot missing start position Xst".

Here, typically, ejection abnormality is a state where ink cannot be ejected from the nozzle 26*b* and in this case, dot missing of the pixel occurs in the image printed on the medium P. furthermore, as described above, in a case of the ejection abnormality, even if ink is ejected from the nozzle 26*b*, since the amount of ink is too small or a flight direction (trajectory) of the ejected ink droplets is deviated or the ink droplets are not appropriately landed, it is also referred to as dot missing of the pixel. Furthermore, the nozzle 26*b* included in the ejecting section D in which the ejection abnormality occurs may be referred to as "missing nozzle".

The print control section 71 checks the flag of the storage section 55 whenever recording of one pass is completed and when detecting the ejection abnormality in the previous pass, reads the nozzle position information NP, information of the ejection abnormality detection start position Xst, information of an ejection abnormality detection end position Xe from the storage section 55. Then, the print control section 71 obtains a first transport amount, by which the normal nozzle can be positioned in the abnormal nozzle, based on the nozzle position information NP before the transport of the medium P to the next pass and transports the medium P to the next scanning position by the first transport amount. Then, the print control section 71 ejects the ink droplets from the ejection abnormality detection start position Xst to the final dot position of the previous pass from the normal nozzle and performs a first complementary recording that complements a dot missing region Aom occurred in the previous pass with the first dot that is recorded by the normal nozzle Nn in the next pass (see FIG. 12).

Furthermore, the print control section 71 calculates a second transport amount remaining from the pass in which the first complementary recording is performed to the usual next scanning position. That is, the second transport amount is equivalent to a value obtained by subtracting the first transport amount from the usual (defined) transport amount to the next scanning position when the abnormal nozzle does not occur. Then, after the medium P is transported by the second transport amount, the second complementary recording is performed to make a dot missing row (white streak) inconspicuous by increasing recording density by increasing the dot of an adjacent row to the row (dot missing row) of the abnormal nozzle in the following the next scanning with respect to the pass in which the abnormal nozzle is detected, that is, the next pass (second scanning) of the pass (first scanning) in which the first complementary recording is performed. In the embodiment, particularly, near complementation (second complementary recording) is performed. The near complementation is performed to make the dot missing row (white streak) inconspicuous by a near dot (second dot) that is greater than original both adjacent rows to the dot missing row by increasing the size of the dot of the both adjacent rows to the abnormal nozzle Na (missing nozzle) greater than the size of the dot defined from the initial printing data using the both adjacent normal nozzles Nn to the abnormal nozzle Na. Moreover, the print control section 71 performs transport control of the medium P by controlling the transport motor 31 based on a count value of the PF counter 74.

Figure 9:
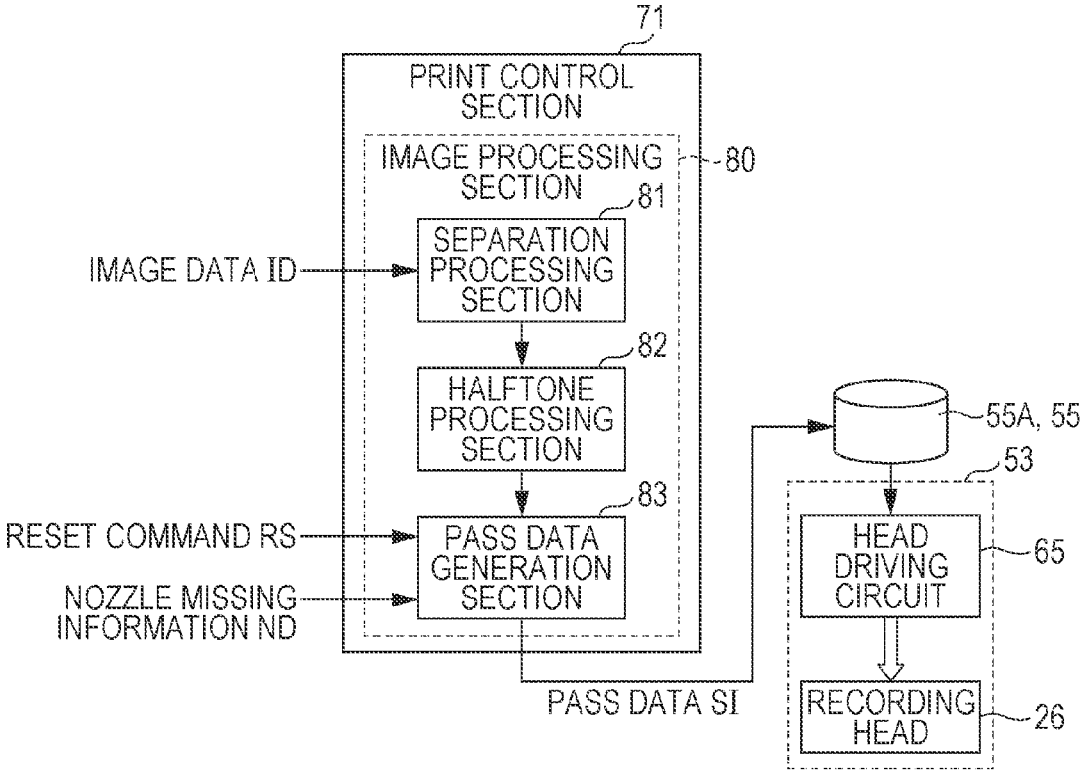
FIG. 9 is a block diagram illustrating a functional configuration of a recording system of the printer.

As illustrated in FIG. 9, the print control section 71 includes an image processing section 80 that performs image processing (data processing) generating the pass data SI from the image data ID by inputting the image data ID in the printing data PD. The image processing section 80 includes a separation processing section 81, a halftone processing section 82, and a pass data generation section 83. The separation processing section 81 separates the image data after resolution conversion after the image data ID is resolution-converted to a specified print resolution into a plurality pieces of image data for each color component of a printing color system (CMYK color system). For example, when performing color printing, the separation processing section 81 separates the image data ID into each image data of 3 colors of CMY, that is, the image data of cyan (C), the image data of magenta (M), and the image data of yellow (Y).

Next, the halftone processing section 82 performs halftone processing for reducing a gradation value for separated each image data. Each image data is converted into, for example, four gradations from a predetermined gradation (for example, 256 gradations) by the halftone process. Next, the pass data generation section 83 generates pass data for one pass by arranging pixels (dots) of the halftone data in order of ejection of the nozzles 26*b* (#1 to #180 in FIG. 2) of the recording head 26. The halftone is stored in an output buffer 55A configured of a predetermined storage region of the storage section 55. Then, a transfer section (not illustrated) sequentially transfers pass data from the storage section 55 to the head driving circuit 65 by instruction of the print control section 71. Then, the head driving circuit 65 performs ejection control for ejecting the ink droplets from the nozzle 26*b* based on the pass data in the course of the recording head 26 moving for one pass.

Here, if the abnormal nozzle is detected in the nozzle inspection that is performed in the middle of printing of one pass, a reset command RS and dot missing information ND are input from the determination section 72 to the pass data generation section 83. The pass data generation section 83 stops pass data generation process if the reset command RS is input. Then, the dot missing information ND that is input by the pass data generation section 83 includes information indicating that in the abnormal nozzle, dot missing occurs from which dot position (pixel position) to which dot position in the scanning direction X in which column. The pass data generation section 83 reconstructs the pass data for performing the second complementary recording in which the dot missing row is complemented by the second dot by forming the second dot (near dot) having a size greater than the dot size that is determined based on the printing data in both adjacent rows to the dot missing row using both adjacent normal rows in the nozzle column direction with the abnormal nozzle interposed therebetween. Then, the pass data generation section 83 stores the reconstructed pass data the output buffer 55A of the storage section 55.

Figure 10A:
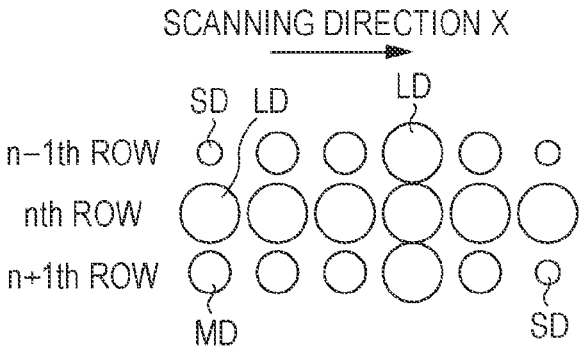
FIGS. 10A to 10D are schematic diagrams illustrating a second complementary recording.
Figure 10B:
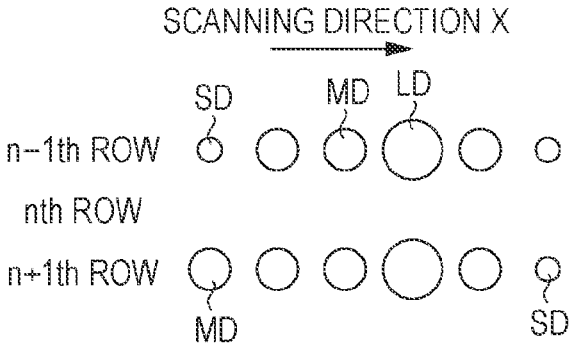

Next, the second complementary recording (near complementation) will be described with reference to FIGS. 10A to 10D. FIG. 10A illustrates a portion of an image in which dots are drawn by the normal nozzle. In the embodiment, the pass data SI is dot data of four gradations and the image is drawn by four gradations of the large dot, the medium dot, the small dot, and no dot to represent a picture or a photo. In a dot image of FIG. 10A, for example, if the nozzle to record the dot column of the nth row is the abnormal nozzle, as illustrated in FIG. 10B, the dot missing region Aom in which the dot is missed occurs in the nth row. The dot missing region Aom (white streak) of the nth row is inconspicuous by increasing the size of the dot using both adjacent normal nozzles in the nozzle column direction with respect to the abnormal nozzle for recording the nth row.

Figure 10C:
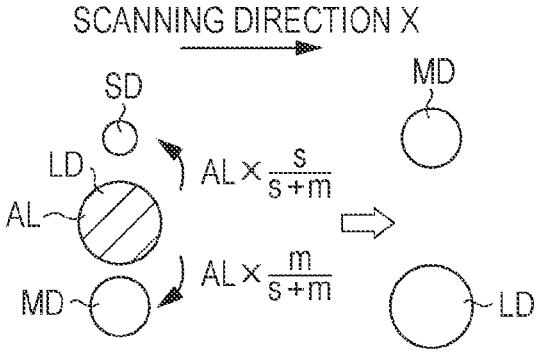
Figure 10D:
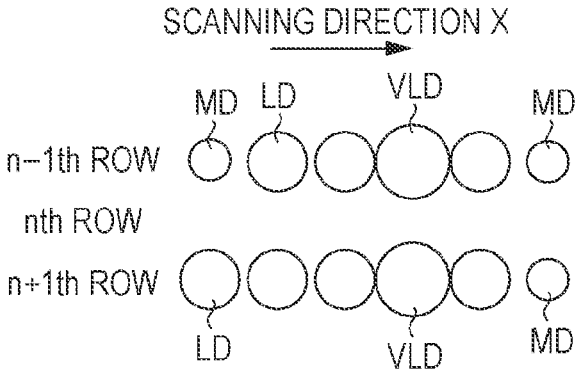

In this case, as illustrated in FIG. 10D, the size of the dots of (n−1)th row and (n+1)th row that are both adjacent rows to the nth row of dot missing is changed to a size greater than the size of the dot determined based on the printing data PD (specifically, the image data ID). Here, the size of the dot changed to be increased is set to be a size by which an area or a mass of the missing dot of the dot size determined based on the printing data PD in the dot missing region Aom is complemented.

As illustrated in FIG. 10C, the size of the dot to be changed is determined by calculation based on the size of the dot of both adjacent rows determined based on the printing data and the size of the dot that is missed in the dot missing region Aom. For example, the area of the dot of the nth row or ink mass is apportioned by a ratio of the area or the ink mass of the dot of the (n−1)th row and the dot of the (n+1)th row. That is, as illustrated in FIG. 10C, the ratio of the area of the ink mass of a first dot (for example, small dot) of the (n−1)th row and a second dot (for example, medium dot) of the (n+1)th row which are positioned both sides adjacent to the dot (large dot in the same view) of the nth row disappeared by the abnormal nozzle is "s:m". If the area or ink mass of the disappearing dot is AL, AL·s/(s+m) is added to the area or ink mass of the first dot and AL·m/(s+m) is added to the area or ink mass of the second dot.

The size of the first dot is determined to the dot size corresponding to the largest threshold exceeding each threshold in which the area or ink mass of the first dot defines the dot sizes of large, medium, and small after adding AL·s/(s+m). Furthermore, The size of the second dot is determined to the dot size corresponding to the largest threshold exceeding each threshold in which the area or ink mass of the second dot defines the dot sizes of large, medium, and small after adding AL·s/(s+m). Thus, in the example of FIG. 10C, the first dot is adjusted from the small dot SD to the medium dot MD and the second dot is adjusted from the medium dot MD to the large dot LD.

The dot size of adjacent both sides is increased by the adjustment to complement the color of the disappearing dot. However, the dot size is set to be predetermined gradation. Thus, if the dot size after adjustment exceeds each stepwise threshold distinguishing the large, medium, and small dots, the dot size of the threshold or less is not changed and the dot may not be greatly changed. However, the dot size may be changed to a large dot size always to one rank or more by selection of threshold to be set.

Ejection control of the recording head 26 by the control section 51 will be described with reference to FIGS. 11 to 15. In FIGS. 11 to 15, a relative positional relationship between the medium P and the recording head 26 which are relatively moved each other in the transport direction Y when the medium P is transported in the transport direction Y is drawn as movement of the recording head 26 with respect to the medium P on the upstream side of −Y in the transport direction. Furthermore, in FIGS. 11 to 15, an example of band printing is illustrated in which all nozzles 26*b* (#1 to #180) arranged in the nozzle column direction are used in printing and are transported in a defined transport amount corresponding to lengths of all nozzles 26*b* (180× nozzle pitch) in the nozzle column direction. Furthermore, in the recording head 26 in FIGS. 11 to 15, an example is schematically illustrated in which only one (one color) nozzle column is drawn as a representative of the plurality of nozzle columns and the number of the nozzles 26*b* configuring the nozzle column is also eight. Furthermore, in FIGS. 12 and 13, density of the first dot DT1 and the second dot DT2 formed with complementary recording is different from that of other dots DT to be easily distinguished, but in practical, each of the dots DT1 and DT2 is formed with color based on the printing data PD.

Figure 11:
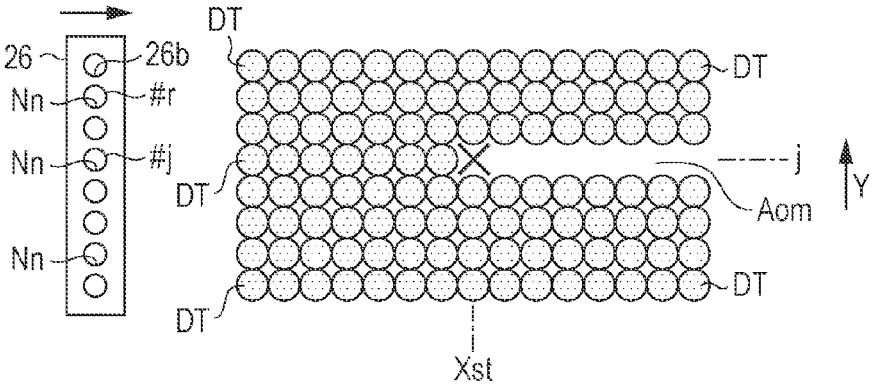
FIG. 11 is a schematic diagram illustrating a shape in which dot missing occurs by the abnormal nozzle during scanning.

As illustrated in FIG. 11, during scanning in which the recording head 26 forms the dots by ejecting the ink droplets from the nozzle 26*b*, whenever the recording head 26 reaches the inspection position set at a plurality of dot intervals in the scanning direction X, the ejection abnormality detection section 67 performs the nozzle inspection after the ink droplets are ejected from the nozzle 26*b* or based on the residual vibration signal Vout at the time of fine vibration. For example, as illustrated in FIG. 11, if the abnormal nozzle is initially detected in the middle of one scanning of the recording head 26, the position at that time is stored in the storage section 55 as the ejection abnormality detection start position Xst. Since the example of FIG. 11 is an example in which the nozzle 26*b* of jth is detected as the abnormal nozzle, a flag corresponding to the nozzle of jth is set. Thus, it can be seen that the nozzle of the number corresponding to the flag in the set state is the abnormal nozzle and the ejection abnormality detection start position Xst and after in the scanning direction X is the dot missing region Aom. In this example, the flag in association with the number of the nozzle corresponds to the nozzle position information NP specifying the position of the abnormal nozzle.

Next, the print control section 71 calculates a first transport amount Y1 by which the normal nozzle Nn is disposed on the row of the dot missing region Aom. In this case, the first transport amount Y1 is calculated as a value that is shorter than a defined transport amount Yp that is used for the transport of the medium P in normality in which the abnormal nozzle does not exist. Here, as the normal nozzle Nn used for the first complementary recording, the normal nozzle Nn, which is in a position on the downstream side further than the position of the abnormal nozzle Na in the transport direction and is in a position away the shortest transport amount or more that is the shortest distance at which the transport mechanism 54 can transport from the abnormal nozzle Na on the downstream side in the transport direction, is selected by the print control section 71. For example, the normal nozzle in a position of a Rth (R is a natural number) or more with respect to the abnormal nozzle Na on the downstream side in the transport direction is determined.

Figure 12:
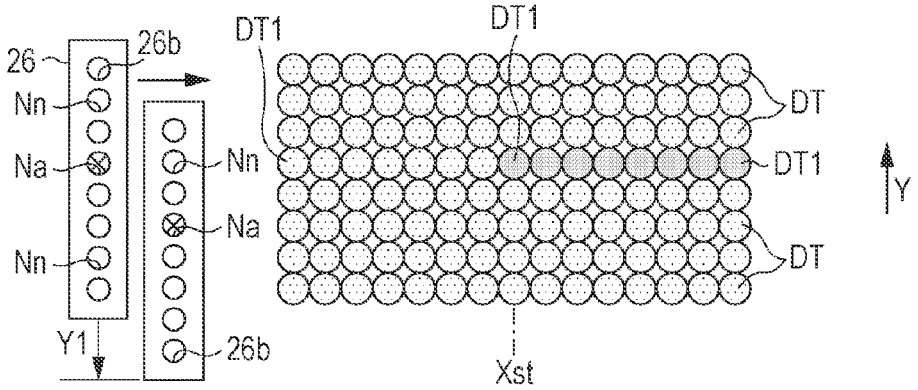
FIG. 12 a schematic diagram illustrating a first complementary recording in which a dot missing region is complemented by a first dot.

Next, as illustrated in FIG. 12, the sheet is transported by the first transport amount Y1 in the transport direction Y. Thus, in FIG. 12, the recording head 26 is relatively moved by the first transport amount Y1 with respect to the sheet on the upstream side in the transport direction Y and the normal nozzle Nn of #r is disposed in a row that belongs the dot missing region Aom. Then, in the next scanning of the recording head 26, if the recording head 26 reaches the ejection abnormality detection start position Xst, ejection of the ink droplets is started from the normal nozzle Nn and thereby formation of the first dot DT1 is started from the ejection abnormality detection start position Xst. Then, if the first dot DT1 is formed to the dot end position, ejection of the ink droplets from the normal nozzle Nn is stopped. Thus, as illustrated in FIG. 12, the first complementary recording is performed and the dot missing region Aom is complemented by the first dot DT1 formed by the normal nozzle Nn in the next pass of a detection pass of the abnormal nozzle.

Next, the print control section 71 calculates a remaining second transport amount Y2 required to reach the scanning position when it is transported in a usual transport amount if the abnormal nozzle does not occurs. That is, the second transport amount Y2 (=Yp−Y1) that is obtained by subtracting the first transport amount Y1 from the usual transport amount Yp is calculated.

Figure 13:
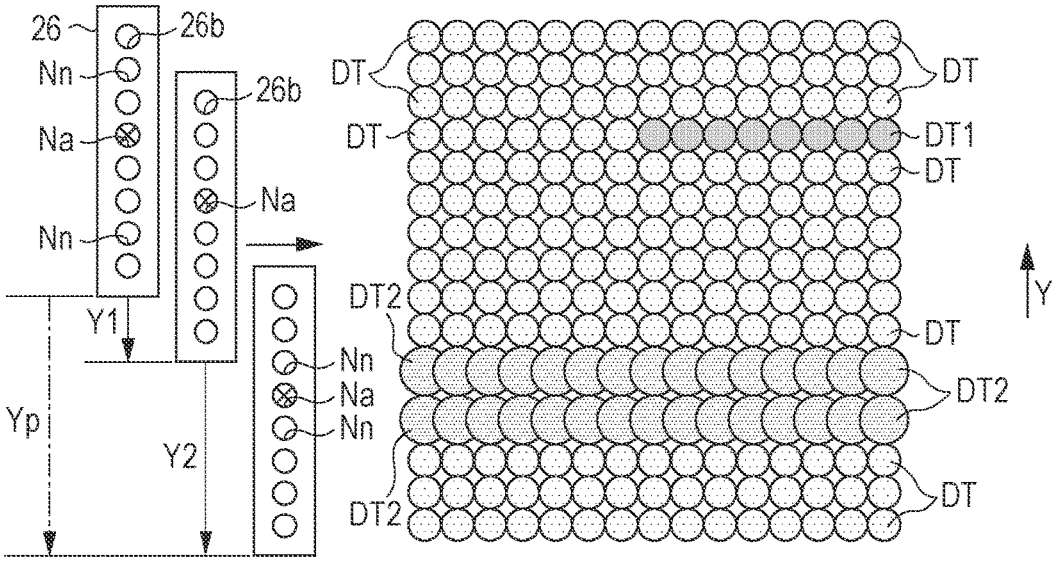
FIG. 13 a schematic diagram illustrating a second complementary recording in which a row of the abnormal nozzle is complemented by a second dot.

Next, as illustrated in FIG. 13, the medium P is transported by the second transport amount Y2 in the transport direction Y. Thus, in FIG. 13, if the abnormal nozzle Na does not occur, the recording head 26 is disposed in the scanning position in which the recording head 26 can be disposed by the transport of the next usual transport amount Yp. Then, in the next scanning of the recording head 26, the second complementary recording is performed in which the second dot DT2 is formed by ejecting the ink droplets of an increased amount from both adjacent normal nozzles Nn by increasing the amount of the ink droplets to be the dot size greater than the size of the dot determined based on the printing data PD from the both adjacent normal nozzles Nn of the abnormal nozzle Na. As illustrated in FIG. 13, since the second dot DT2 is formed in the dot size greater than the size of the dot determined based on the printing data, white streak due to dot missing by the abnormal nozzle Na is inconspicuous. Then, as illustrated in FIG. 13, in the following the next pass and after of the detection pass of the abnormal nozzle, the second complementary recording is performed by both adjacent rows of the row of the abnormal nozzle Na, the second dot DT2 having the size greater than the size of the dot determined based on the printing data is formed in both adjacent rows, and thereby the row of dot missing of the abnormal nozzle Na is complemented. Moreover, when the second complementary recording is performed, usual recording is performed with the size of the dot determined based on the printing data PD in rows other than both adjacent rows of the row of the abnormal nozzle Na.

Figure 14:
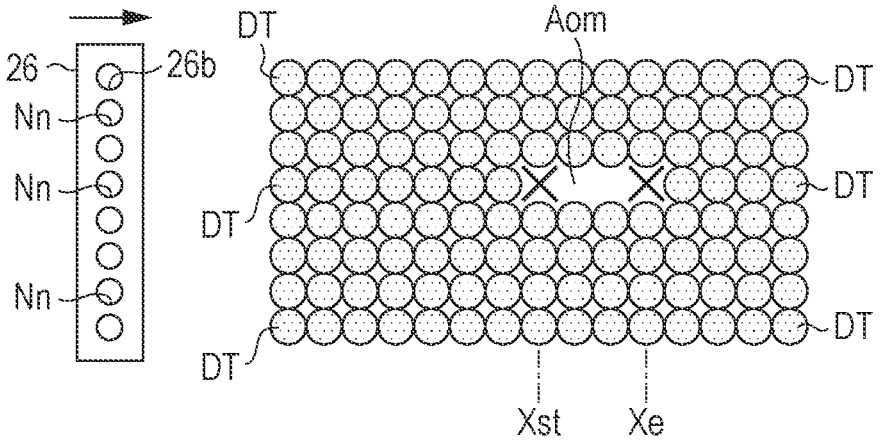
FIG. 14 is a schematic diagram illustrating dot columns if the abnormal nozzle is normally restored in the same scanning after the abnormal nozzle occurs.

Furthermore, as illustrated in FIG. 14, the dot missing region Aom is started from the ejection abnormality detection start position Xst, but thereafter, the nozzle 26*b* that is the abnormal nozzle Na once may be restored to the normal nozzle Nn during the same scanning. If the ejection abnormality detection section 67 detects that the abnormal nozzle Na (the ejection abnormality) is restored to the normal nozzle Nn (normal ejection), information of dot missing end position regarding the previous dot position of the position at that time as a dot missing end position Xe is stored in a predetermined storage region of the storage section 55. Thus, in the example of FIG. 14, the print control section 71 sets a flag F1 corresponding to the abnormal nozzle and each piece of information of the ejection abnormality detection start position Xst and the ejection abnormality detection end position Xe is stored in the predetermined storage region of the storage section 55.

Next, the print control section 71 calculates the first transport amount Y1 in which the normal nozzle Nn can be disposed in the dot missing region Aom formed by the abnormal nozzle Na.

Figure 15:
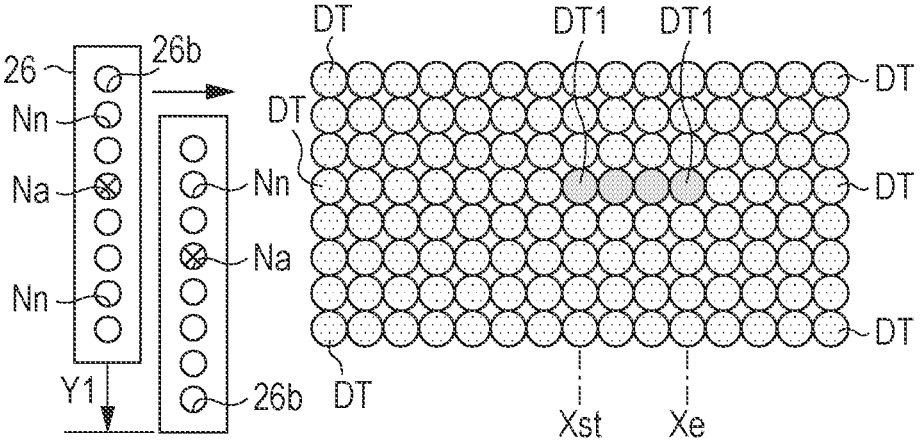
FIG. 15 is a schematic diagram illustrating the first complementary recording for complementing a dot missing region in FIG. 14.

Then, as illustrated in FIG. 15, the medium P is transported by the first transport amount Y1 integrally in the transport direction Y. Thus, in FIG. 15, the recording head 26 is relatively moved with respect to the medium P by the first transport amount Y1 on the upstream side in the transport direction Y and the normal nozzle Nn is disposed in the row belongs the dot missing region Aom. Then, in the next scanning of the recording head 26, the recording head 26 reaches the ejection abnormality detection start position Xst, ejection of the ink droplets from the normal nozzle Nn is started and thereby formation of the first dot DT1 is started from the ejection abnormality detection start position Xst. Then, the normal nozzle Nn reaches the ejection abnormality detection end position Xe and if the formation of the final first dot DT1 is completed in the ejection abnormality detection end position Xe, the first complementary recording is completed. Thus, as illustrated in FIG. 15, in the next pass of the detection pass of the abnormal nozzle, the first complementary recording is performed and the dot missing region Aom from the ejection abnormality detection start position Xst to the ejection abnormality detection end position Xe is complemented by the first dot DT1 formed by the normal nozzle Nn.

In the example of FIGS. 14 and 15, after the first complementary recording is completed in FIG. 15, the print control section 71 disposes the recording head 26 in the next scanning position by transporting the sheet by the second transport amount Y2. Since the abnormal nozzle does not exist when the first complementary recording is completed, thereafter, the recording head 26 performs usual printing (band printing in this example) as long as the abnormal nozzle is not detected during scanning of the recording head 26. That is, printing on the sheet is proceeded by substantially alternately performing printing for one pass by moving the recording head 26 in the scanning direction X, returning the recording head 26 to print starting position, and transporting the sheet by the transport amount Yp.

Next, image processing (data processing) of the image data ID and control flow of recording in the print control section 71 will be described with reference to FIGS. 16A and 16B. FIG. 16A is a data processing flow in ejection normality and FIG. 16B is a data processing flow in the ejection abnormality. In the print control section 71, separation processing PR1 by the separation processing section 81, halftone processing PR2 by the halftone processing section 82, and pass data generation processing PR3 by the pass data generation section 83 illustrated in FIG. 9 are executed in the image data ID. The generated pass data is stored in the output buffer 55A. the recording head 26 performs record processing PR4 based on the pass data.

As illustrated in FIG. 16A, in the process of the first pass, the separation processing PR1, the halftone processing PR2, and the pass data generation processing PR3 are sequentially performed in order with respect to the image data ID, and the record processing PR4 is performed by the scanning of the recording head 26. If the separation processing PR1 of the first pass is completed, the separation processing PR1 of a second pass is started and the separation processing PR1 of the second pass and the halftone processing PR2 of the first pass are proceeded in parallel. Then, if the separation processing PR1 of the second pass is completed, the separation processing PR1 of a third pass is started, the separation processing PR1 of the third pass, the halftone processing PR2 of the second pass, and the pass data generation processing PR3 of the first pass are performed. Then, if the pass data is generated in the pass data generation processing PR3 of the first pass, the record processing is started based on the pass data. As described above, the pass data of the second pass is generated during record of the first pass is performed. Since the pass data of the second pass is already generated after the record processing PR4 of the first pass is completed and until the record processing PR4 of the second pass is started, the record processing PR4 of the second pass is performed based on the pass data. Hereinafter, similarly, the record processing PR4 of the third pass is performed based on the pass data of the third pass and the record processing PR4 of the fourth pass is performed based on the pass data of the fourth pass in order. As described above, the processing of the separation, the halftone, and the generation of the pass data of the nth pass is completed until the record of nth pass is started.

Next, data processing when the ejection abnormality occurs illustrated in FIG. 16B will be described. For example, if the abnormal nozzle Na (missing nozzle) is detected by the ejection abnormality detection section 67 and the determination section 72 in the middle of the record of the nth pass (second pass in the example of FIG. 16B), the reset command RS is output from the determination section 72 to the print control section 71. In the print control section 71, the reset command RS from the determination section 72 illustrated in FIG. 9 is input into the pass data generation section 83. The pass data generation section 83 stops the pass data generation processing PR3 if the reset command RS is input. Then, the pass data generation section 83 obtains the nozzle position information NP of the detected abnormal nozzle and the ejection abnormality information ND including the ejection abnormality detection start position Xst and the ejection abnormality detection end position Xe.

Then, the pass data generation section 83 stops pass data generation processing of the next pass (third pass in the example of FIG. 16B) of the pass in which the abnormal nozzle is detected during the record by the reset command RS and generates the pass data for the first complementary recording that performs complementation by the first dot DT1 by the normal nozzle using the halftone data generated for the scanning (for example, second pass) when detecting the abnormal nozzle. Here, the first dot DT1 is a dot of the same size as the dot size determined based on the printing data. Then, in the next pass of the pass in which the abnormal nozzle is detected, the print control section 71 performs the first complementary recording based on the pass data for the first complementary recording by the recording head 26. As a result, the dot missing region Aom due to the abnormal nozzle is complemented by the first dot DT1.

The pass data for the second complementary recording (for the near complementation) using the halftone data generated for the next pass (for example, third pass) of the pass in which the abnormal nozzle is detected in a period in which the first complementary recording is performed. Then, in the following the next scanning of the pass in which the abnormal nozzle is detected, the print control section 71 performs the second complementary recording based on the pass data for the second complementary recording by the recording head 26. As a result, white streak of the row of the abnormal nozzle Na is inconspicuous by forming the second dot DT2 having the size that is greater than the size of the dot determined based on the printing data in the both adjacent rows of the row of the abnormal nozzle Na from the both adjacent normal nozzles with the abnormal nozzle interposed therebetween.

Next, an operation of the printer 11 will be described with reference to FIGS. 17 and 18.

If a user instructs execution of printing by operating an operation section (keyboard or mouse) in the host computer 100, the printer 11 receives the printing data from the host computer 100 through wired or wireless communication. Furthermore, image data from a memory card or a USB memory connected to a connection section of an input interface (not illustrated) included in the printer 11 may be read as the printing data. If the printer 11 receives the printing data, the printer 11 executes print processing for printing the image and the like based on the printing data. The control section 51 (specifically, computer within the control section 51) within the printer 11 executes a program of a printing control routine illustrated by flowcharts in FIGS. 17 and 18. Here, FIG. 17 is a main routine of the printing control and FIG. 18 is a sub-routine illustrating control of one scanning in the printing control. If the control section 51 receives instruction of execution of printing, the control section 51 feeds the medium P such as the sheet to the printing start position. Then, if feeding of the medium P to the printing start position completed, the control section 51 start the printing control by executing the programs illustrated by the flowcharts of FIGS. 17 and 18.

Figure 17:
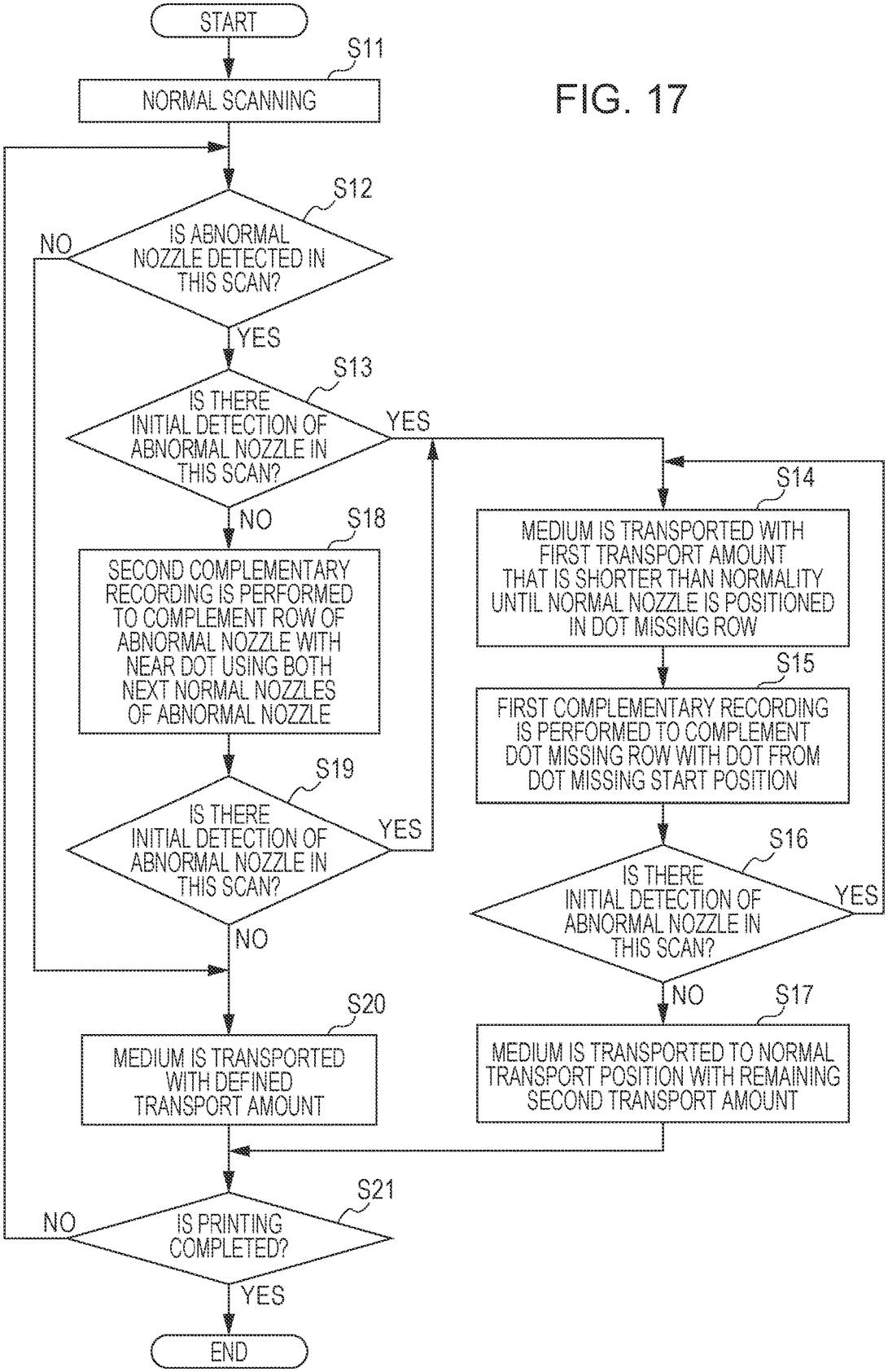
FIG. 17 is a flowchart illustrating a print control routine.

First, in step S11 in FIG. 17, the usual scanning is performed. That is, the carriage motor 25 is driven, the carriage 22 is moved in the scanning direction X, and thereby scanning of the recording head 26 is performed. In the process of the scanning of the recording head 26, the ink droplets are ejected from the nozzle and printing for one pass is performed. In the embodiment, the nozzle inspection is executed during scanning for one pass of the recording head 26. The nozzle inspection may be performed in all nozzles for all nozzles as the inspection target or may be performed in a part of the nozzles such as a plurality of every other dots for all nozzles. Furthermore, all dots with respect to a part of the nozzles may be the inspection target or a part of the dots such as the plurality of every other dots for a part of the nozzles may be the inspection target. However, in a case of the configuration in which all dots are the inspection target for all nozzles, processing ability of the computer of the control section 51 is all a matter, but since data processing amount of the nozzle inspection becomes enormous, there is a concern that a processing speed becomes slow. In the embodiment, as an example, a part of the dots for all nozzles is the inspection target. For example, the inspection is performed in the first dot from the printing start position (ejecting start position) in the scanning direction X and, thereafter, the nozzle inspection is performed every other N (N is a natural number of 2 or more) dot. As an example, N is a predetermined number within a range of 5 to 100.

Here, the scanning processing routine illustrated in FIG. 18 executed by the control section 51 during scanning of the recording head 26 will be described. The control section 51 executes the scanning processing routine if scanning of the recording head 26 is started. Moreover, in the scanning processing routine, two types of the flags F1 and F2 are used for the determination. The flag F1 indicates presence or absence of the current abnormal nozzle and if the abnormal nozzle is absent, F1=0, and if the abnormal nozzle is present, F1=1. Furthermore, the flag F2 indicates presence or absence of dot missing and if F2=1, dot missing is present and if F2=0, dot missing is not present. For example, the flags F1 and F2 are reset (F1=0 and F2=0) when turning on power supply or before start of the printing. Then, values according to the nozzle inspection result after start of the printing (after start of scanning) are set in flags F1 and F2.

Figure 18:
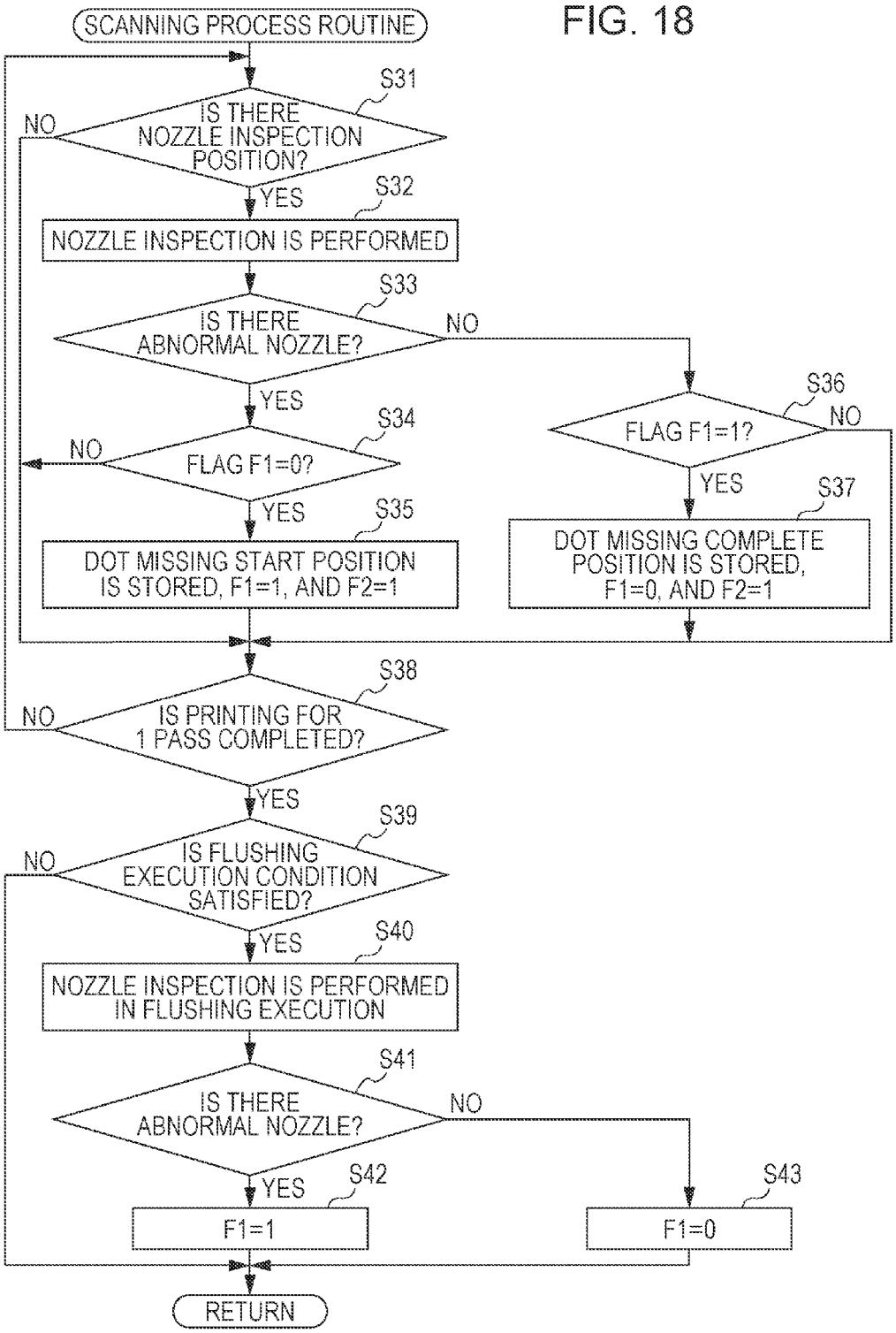
FIG. 18 is a flowchart illustrating a scanning processing routine.

In step S31 in FIG. 18, it is determined whether or not the recording head 26 is in the nozzle inspection position. If the recording head 26 is in the nozzle inspection position, the process proceeds to step S32. If the recording head 26 is not in the nozzle inspection position, the process proceeds to step S38. For example, if all dots are the inspection target, whenever the recording head 26 proceeds in a distance for one dot, since every time is in the nozzle inspection position, the process proceeds to step S32 for every time. On the other hand, of the nozzle inspection position is set to every other N dot, it is determined that the recording head 26 is in the nozzle inspection position when the recording head 26 is in the position of every other N dot and the process proceeds to step S32.

In step S32, the nozzle inspection is executed. That is, the ejection abnormality detection section 67 performs the nozzle inspection by obtaining the detection waveform based on the vibration waveform obtained by performing waveform shaping on the residual vibration signal Vout that is input after ejection timing, measures at least the period of the period and the amplitude of the detection waveform, and comparing at least the measured period with a plurality of thresholds. In the nozzle inspection, it is detected whether the nozzle of the inspection target is the normal nozzle or is the abnormal nozzle. In this case, the abnormal nozzle is detected by the causes (air bubble is mixed, dried, and paper dust is attached). Then, the ejection abnormality detection section 67 outputs the detection signal Ds indicating the detection result to the control section 51. In this case, if the nozzle of the inspection target is all nozzles, the determination section 72 inputs a plurality (number of ink colors× the number of nozzles for each nozzle column) of detection signals Ds for all nozzles by each ink color. On the other hand, if the nozzles of the inspection target is a part of the nozzles, the determination section 72 inputs the detection signal Ds for a part of the nozzles by each ink color. Moreover, in the embodiment, the process of step S32 corresponds to an example of the detection step.

Next, in step S33, it is determined whether or not the nozzle is the abnormal nozzle. That is, the determination section 72 determines the nozzles of the inspection target are the normal nozzle or the abnormal nozzle based on the detection signal Ds for all nozzles of the inspection target. If the nozzle is the abnormal nozzle, the process proceeds to step S34. It is determined whether or not the flag F1 is "0". On the other hand, if there is no the abnormal nozzle (if all nozzles of the inspection target are the normal nozzles), the process proceeds to step S36 and it is determined whether or not the flag F1 is "1". Here, if the flag F1 is "0", the abnormal nozzle is absent at that time and the abnormal nozzle that is currently detected is initially detected in the current scanning. In this case, in step S35, the dot missing start position Xst is stored in the storage section 55, the flag F1=1, and the flag F2=1. On the other hand, if it is determined that the abnormal nozzle is absent in step S33 (negative determination), in step S36, if the flag F1 is "1", the abnormal nozzle is already present by that time. That is, if the abnormal nozzle is not detected even though the abnormal nozzle is already present by that time, it means that the abnormal nozzle is restored to the normal nozzle. Thus, in step S37, the dot missing end position Xe is stored in the storage section 55, the flag F1=0, and the flag F2=1.

Here, the flag F2 indicates presence or absence of dot missing, if F2=1, dot missing is present, and if the F2=0, dot missing is not present. Thus, if F2=1, the first complementary recording is selected. On the other hand, if F1=1, but F2=0, since the abnormal nozzle is present but dot missing is not present, the second complementary recording is selected.

Then, in step S38, whenever the recording head 26 reaches the nozzle inspection position (positive determination in step S31), the nozzle inspection is executed (step S32) until it is determined that printing of one pass is completed (positive determination in step S38), that is, during scanning of the recording head 26. Then, flag processing and a storage processing of position information capable of specifying the dot missing region Aom such as the dot missing start position Xst or the dot missing end position Xe are performed (step S34 to step S37) according to a determination result (step S33) of presence or absence of the abnormal nozzle by the nozzle inspection. Then, if printing of one pass is completed, the process proceeds to step S39.

In step S39, it is determined whether or not flushing execution conditions are satisfied. For example, it is determined that the flushing execution conditions are satisfied based on elapsed time from the previous flushing execution time reaching a predetermined time. If the flushing execution conditions are satisfied, the process proceeds to step S40. On the other hand, if the flushing execution conditions are not satisfied, the routine is connected.

In step S40, flushing is executed and the nozzle inspection is executed during flushing execution. The ejection abnormality detection section 67 executes the nozzle inspection for all nozzles of the inspection target based on the residual vibration signal Vout for each nozzle and outputs the detection signal Ds indicating the inspection result of all nozzles of the inspection target to the determination section 72.

In step S41, it is determined whether or not there is the abnormal nozzle. That is, the determination section 72 determines whether the nozzles of the inspection target are the normal nozzles or the abnormal nozzles based on the detection signal Ds for all nozzles of the inspection target. If the nozzles are the abnormal nozzles, the process proceeds to step S42 and the flag F1 is "1". On the other hand, if the abnormal nozzle is not present (all nozzles of the inspection target are the normal nozzles), the process proceeds to step S43 and the flag F1 is "0".

The nozzle inspection is performed for each dot or the plurality of every other dots for the nozzles of the inspection target in the middle of performing printing for one pass by such a scanning processing routine. Then, at the time that the inspection for one pass is completed, flag information (flags F1 and F2) indicating the nozzle inspection result and the position information (Xst, Xe, and the like) capable of specifying the dot missing region Aom are stored in the storage section 55.

Returned to FIG. 17, after usual scanning (step S11) described above is performed, in the next step S12, it is determined whether or not the abnormal nozzle is detected in the current scanning. If the abnormal nozzle is detected, the process proceeds to step S13 and if the abnormal nozzle is not detected, the process proceeds to step S18.

In step S13, it is determined whether or not the abnormal nozzle is initially detected in the current scanning. If the abnormal nozzle is initially detected in the current scanning, the process proceeds to step S14 and if the abnormal nozzle is not initially detected in the current scanning, the process proceeds to step S18. Here, if the abnormal nozzle is initially detected in the current scanning, the dot missing region Aom due to dot missing is formed in the region after the position in which at least the abnormal nozzle is initially detected in the row of the abnormal nozzle. If such a dot missing region Aom is present, the process proceeds to step S14 and if such a dot missing region Aom is not present, the process proceeds to step S18.

In step S14, the medium P is transported with the first transport amount Y1 that is shorter than usual until the normal nozzle is positioned in the dot missing row. Here, the normal nozzle is selected to be in the position on the downstream side in the transport direction further than the position of the abnormal nozzle and in the position away by the shortest transport amount or more on the downstream side in the transport direction from the abnormal nozzle by the print control section 71. For example, the normal nozzle that is in the position of Rth (R is a natural number) or more on the downstream side in the transport direction with respect to the abnormal nozzle Na is determined. Then, if the normal nozzle is determined, the medium is transported in the transport direction Y by the first transport amount Y1 until the normal nozzle is positioned in the dot missing row. Moreover, in the embodiment, the process of step S14 corresponds to an example of the first moving step.

In step S15, the first complementary recording, in which the dot missing row is complemented by the dot from the dot missing start position Xst, is performed. As a result, the first dot is formed by the normal nozzle from the dot missing start position Xst with respect to the dot missing region Aom formed in FIG. 11 and thereby the first complementary recording, in which the dot missing region Aom is complemented by the first dot DT1, is performed. In this case, the pass data that is used in first complementary recording is generated as follows. That is, if the abnormal nozzle is detected in the previous pass, at that time, generation of the pass data is stopped and generation of the pass data for the first complementary recording is started. Thus, even if the first complementary recording is performed in the next pass of the pass in which the abnormal nozzle is detected, the first complementary recording is immediately started without any appreciable delay. Moreover, in the embodiment, the process of step S15 corresponds to an example of the first complementary recording step.

In step S16, it is determined whether or not the abnormal nozzle is initially detected in the current scanning. If the abnormal nozzle is initially detected in the current scanning, the process proceeds to step S14 and if the abnormal nozzle is not initially detected in the current scanning, the process proceeds to step S17. Here, if the abnormal nozzle is initially detected in the current scanning, the dot missing region Aom is formed in the region after the position in which at least the abnormal nozzle is initially detected in the row of the abnormal nozzle. If such a dot missing region Aom is present, the process proceeds to step S14 and if such a dot missing region Aom is not present, the process proceeds to step S17.

For example, the abnormal nozzle occurs in the current scanning in which the first complementary recording is performed, complementation by the first dot DT1 of the dot missing region is interrupted. In this case, since it is determined that the abnormal nozzle Na is initially detected in the current scanning (positive determination in step S16), another normal nozzle Nn is disposed again in the dot missing region Aom by the transport of the first transport amount Y1. Then, the first complementary recording, which complements the dot missing region Aom by the first dot DT1 by the normal nozzle Nn from the position (the dot missing start position Xst in the previous scanning) in which the first complementary recording is interrupted in the previous scanning, is performed. As described above, even if the abnormal nozzle is initially detected in the middle of the first complementary recording and the first complementary recording is interrupted, the medium P is transported gain by the first transport amount Y1, the nozzle is replaced with another normal nozzle, and the first complementary recording is continuously performed from the interrupted position, and thereby it is possible to finally complement the dot missing region Aom by the first dot DT1 over a plurality times of scanning. Moreover, the first transport amount Y1 is changed by selecting which normal nozzle on the downstream side in the transport direction Y with respect to the abnormal nozzle at that time. As described above, since the dot missing region Aom is complemented by the first dot DT1 by the plurality times of scanning, it is preferable that the normal nozzle, which can decrease the first transport amount Y1 as short as possible, is selected. Moreover, the upper limit number is since in advance and if the number of continuous execution times of the first complementary recording reaches the upper limit number and complementation is not completed even if the execution is up to the upper limit number, it is assumed that the abnormal nozzle is under a situation likely to occur and flushing or maintenance may be performed in the recording head 26.

In step S17, the medium is transported by the remaining second transport amount Y2 (=Yp−Y1) to the usual transport position. Thus, in a case where the abnormal nozzle is not detected, if transport is performed by the defined transport amount Yp, the medium P is transported to the usual transport position (next scanning position) to be reached. Moreover, in the embodiment, the process of step S17 corresponds to an example of the second moving step.

In step S18, the second complementary recording, in which the row of the abnormal nozzle is complemented by the second dot (near dot) using both adjacent normal nozzles of the abnormal nozzle. In this case, the pass data used in the second complementary recording is generated as follows. That is, if the abnormal nozzle is detected in the before the previous pass, generation of the pass data at that time is stopped, generation of the pass data for the first complementary recording that is started is completed, and then generation of the pass data for the second complementary recording is started. Thus, even if the second complementary recording is performed in the before the previous pass of the pass in which the abnormal nozzle is detected, the second complementary recording is immediately started without any appreciable delay.

Then, even in the scanning of the second complementary recording, the scanning processing routine illustrated in FIG. 18 is executed. In the scanning, the inspection of the abnormal nozzle is performed and if the abnormal nozzle is initially detected in the current scanning, the flags F1=1 and F2=1 (positive determination in step S13). In this case, after the second complementary recording is completed, the medium P is transported by the first transport amount Y1 (step S14) and then the first complementary recording is performed.

Furthermore, in the scanning of the second complementary recording, the abnormal nozzle does not eject ink. Thus, even if the abnormal nozzle is restored to the normal nozzle during the second complementary recording, the ink droplets are not ejected. At this time, the ejecting section D corresponding to the abnormal nozzle is driven in a fine vibration mode (an example of vibration driving mode) in which the vibration plate 265 is finely vibrated with intensity of a degree that does not eject the ink droplets. The nozzle inspection is performed by the ejection abnormality detection section 67 detecting the residual vibration of the ejecting section D that is driven in the fine vibration mode. As a result of the nozzle inspection, if the abnormal nozzle is restored to the normal nozzle, the restored normal nozzle is used for recording from the next scanning or the following the next scanning. Thus, it is possible to relatively rapidly return from the second complementary recording to the usual recording compared to a configuration that the inspection of the abnormal nozzle is not performed in the second complementary recording step. Here, if the abnormal nozzle is restored to the normal nozzle, since the pass data (an example of the recording data) for the restored normal nozzle is generated, if generation of the recording data does not match the next scanning in time or if the next scanning cannot be started with small latency time, recording may be performed using the restored normal nozzle from the next scanning.

For example, in FIG. 16B, if the abnormal nozzle Na is restored to the normal nozzle Nn in the nozzle inspection in the second complementary recording, at this time, generation of the pass data for the second complementary recording of the next pass is stopped or generation is completed. At the time to restore to the normal nozzle, the pass data for the second complementary recording, of which the generation is stopped or generation is completed, is discarded and generation of the pass data for recording the restored normal nozzle Nn is started. Thus, the pass data when the abnormal nozzle Na is restored to the normal nozzle Nn is rapidly reconstructed after it is detected that the abnormal nozzle Na is restored to the normal nozzle Nn. Moreover, since the abnormal nozzle Na does not eject ink in the scanning of the second complementary recording, the abnormal nozzle Na may be removed from the nozzle inspection target. Furthermore, in the embodiment, the process of step S18 corresponds to an example of the second complementary recording step.

In step S19, it is determined whether or not the abnormal nozzle is initially detected in the current scanning. If the abnormal nozzle is initially detected in the current scanning, the process proceeds to step S14 and if the abnormal nozzle is not initially detected in the current scanning, the process proceeds to step S20. Here, if the abnormal nozzle is initially detected in the current scanning, the dot missing region Aom is formed in the region after the position in which at least the abnormal nozzle is initially detected in the row of the abnormal nozzle. If such a dot missing region Aom is present, the process proceeds to step S14 and if such a dot missing region Aom is not present, the process proceeds to step S20.

Thus, if the abnormal nozzle is initially detected in the current scanning in the second complementary recording (positive determination in step S19), the medium P is transported by the first transport amount Y1 after the current scanning is completed and the normal nozzle Nn is disposed in the row of the dot missing region Aom by the abnormal nozzle that is initially detected (step S14, see FIG. 12). Then, the recording head 26 is scanned and the first complementary recording, in which the dot missing row is complemented by the first dot from the dot missing start position Xst, is performed (step S15).

On the other hand, if the abnormal nozzle is not initially detected in the current scanning in the second complementary recording (negative determination in S19), the medium P is transported the defined transport amount Yp after the current scanning is not completed (step S20). If printing is not completed (negative determination in S21), if the abnormal nozzle (including the abnormal nozzle that is also present in the previous scanning) is detected in the current scanning (positive determination in step S12) and is not initially detected in the current scanning (negative determination in S13), the second complementary recording, in which the row of the abnormal nozzle is complemented by the second dot of the adjacent row, is performed (step S18). Moreover, if the first complementary recording (step S15) and the second complementary recording (step S18) are performed, since in the next step S15 or S19, since determination process similar to step S13 is performed, in step S13 after the first complementary recording or the second complementary recording is performed, it is negative determination in principle.

Next, in step S20, the medium is transported with a defined transport amount. In the example of band printing, the medium P is transported with the defined transport amount in band printing. As a result, the recording head 26 is disposed in the next scanning position with respect to the medium P.

In step S21, it is determined whether or not the printing is completed. If the printing is not completed, the process proceeds to step S12 and if the printing is completed, the routine is completed.

If the printing is not completed and the abnormal nozzle that occurs in before the previous scanning (pass) is still present, the second complementary recording is performed in the next scanning. Thus, the second complementary recording is continued with the scanning for each time while the abnormal nozzle generated before the previous scanning is present. For example, in the printing, if elapsed time from the previous flushing execution time reaches a set time and flushing execution conditions are satisfied, at this time, if the recording head 26 is in the scanning, the carriage 22 which completes the scanning moves to the home position HP. Then, the flushing is performed in which the ink droplets not related to the printing is ejected from all nozzles 26*b* of the recording head 26 to the cap 35 (step S40 in FIG. 18). In the flushing, the nozzle inspection is performed by the ejection abnormality detection section 67 for all nozzles as the inspection target. As a result of the nozzle inspection, it returns to the usual recording without complementary recording from the next scanning.

On the other hand, regardless of performing the usual scanning so far, the abnormal nozzle may be detected in the nozzle inspection in the flushing. For example, the air bubble B exists in the ink within the cavity 264, the air bubble B is moved in the vicinity of the nozzle 26*b* in the flushing, and then the abnormal nozzle may be detected due to mixing of the air bubble. In this case, the second complementary recording is performed in which the row of the abnormal nozzle is complemented by the second dot DT2 that is recognized in both adjacent rows using both adjacent normal nozzles of the abnormal nozzle. As described above, if the presence of the abnormal nozzle Na is known, before start of the scanning, the next scanning is performed in the second complementary recording.

Furthermore, if a plurality of abnormal nozzles are present over the plurality of nozzle columns, that is, if the normal nozzles are respectively present in the plurality nozzle columns, the first transport amount Y1 is determined such that the normal nozzles are respectively disposed in each row of the abnormal nozzle in the previous scanning. Thus, it is possible to complement the dot missing region Aom due to the plurality of abnormal nozzles by the first dot DT1 by the normal nozzles by one first complementary recording. Furthermore, even if the plurality of abnormal nozzles are present in the same nozzle column, the first transport amount Y1 is determined such that the normal nozzle is disposed in each abnormal nozzle in the previous scanning. Thus, it is possible to complement the dot missing region Aom due to the plurality of abnormal nozzles by the first dot DT1 by the normal nozzles by one first complementary recording.

According to the embodiment described above, the following effects can be obtained.

(1) The dot missing region Aom in the scanning before the first scanning is complemented by the dot DT1 by the normal nozzle Nn. In the second scanning, the second complementary recording, which complements recording target region of the abnormal nozzle, is performed in the dot of the adjacent row by recording the dot of which the size is greater than the size of the dot determined based on the printing data using adjacent normal nozzle Nn to the abnormal nozzle Na. Thus, even if the abnormal nozzle occurs, it is possible to reduce dot missing without lowering throughput of the recording. For example, it is possible to reduce the ink consumed in the printing due to the failure of the printing and to reduce the loss of paper that is wasted in the failure of the printing.

(2) In the first complementary recording, the dot missing region Aom is complemented by the first dot DT1 that is the size of the dot determined based on the printing data PD. Thus, it is possible to obtain recording quality substantially equal to an original recording quality to be obtained by recording if the abnormal nozzle Na is the normal nozzle Nn.

(3) If the ejection abnormality detection section 67 detects the abnormal nozzle Na, the pass data generated on the premise that the second complementary recording is not performed is discarded and the pass data for the first complementary recording is generated to use in the next first scanning. Thus, it is possible to suppress delay of the start of the first complementary recording due to delay of the start of generation of the pass data for the first complementary recording. Thus, it is possible to promptly start the first scanning in which the first complementary recording is performed after the medium P is transported by the first transport amount Y1 after the scanning in which the abnormal nozzle is detected is completed.

(4) In the second complementary recording step, the ejecting section D corresponding to the abnormal nozzle Na is not driven for ejecting the ink (an example of the liquid). The abnormal nozzle Na may eject the ink of an amount smaller than the normal amount or may eject the ink droplets by restoring to the normal nozzle. In this case, recording quality is lowered by surplus of the dots after the second complementary recording by adding the dot missing region Aom due to the ink droplets ejected from the abnormal nozzle Na and the second dot DT2. However, in the second complementary recording step, since the ejecting section Dj corresponding to the abnormal nozzle is not driven for ejecting the ink droplets, the liquid is not ejected from the abnormal nozzle Na. Thus, in the second complementary recording step, it is possible to suppress lowering of recording quality caused by ejecting of the ink droplets from the abnormal nozzle Na.

(5) The ejecting section D corresponding to the abnormal nozzle Na is driven in the fine vibration drive mode (an example of the vibration drive mode), in which ejection of the ink (an example of the liquid) is not accompanied and which vibrates the ink, and the nozzle inspection is performed by the ejection abnormality detection section 67 in which residual vibration of the ejecting section D driven in the fine vibration drive mode is detected. As a result of the nozzle inspection, if the abnormal nozzle is restored to the normal nozzle, the restored normal nozzle is used for recording from the next pass (scanning) or the following next pass (scanning). Thus, it is possible to relatively early return to a usual recording from the second complementary recording step compared to a configuration in which inspection of the abnormal nozzle is not performed in the second complementary recording step.

(6) In the scanning (scanning when detecting the abnormal nozzle) before the first scanning, if it is detected that the abnormal nozzle is restored to the normal nozzle in the same scanning where the abnormal nozzle is detected, in the first complementary recording step, the dot missing region is determined as follows. That is, in the scanning when detecting the abnormal nozzle, the dot missing region is defined as and the range in the scanning direction, which includes the position in which the abnormal nozzle is initially detected in scanning and does not include the position in which restoring of the abnormal nozzle to the normal nozzle is detected. Thus, in the first complementary recording step, the first complementary recording is performed for complementing the dot missing region Aom by the first dot DT1. Thus, it is possible to appropriately perform complementation of the first dot DT1 with respect to the dot missing region Aom.

(7) When the recording head 26 performs cleaning of the nozzles between scanning and scanning, the ejection abnormality detection section 67 examines presence or absence of the abnormal nozzle Na. If the abnormal nozzle Na is restored to the normal nozzle Nn from the detection result of the ejection abnormality detection section 67, the second complementary recording step is not performed in the next second scanning. Thus, it is possible to avoid performing of the second complementary recording in the next second scanning despite the normal nozzle Na is restored to the normal nozzle Nn when the cleaning of the nozzles 26*b* is performed.

(8) The separation processing step for generating a plurality of types of separation data from the image data ID (an example of the recording data), the halftone processing step for generating halftone data from the separation data, and the pass data generating step for generating the pass data in which the dots for one scanning of the recording head 26 are allocated in the nozzle 26*b* are provided. Thus, the recording head 26 performs printing for each scanning (for each pass) based on the pass data generated in advance. On the other hand, when the ejection abnormality detection section 67 detects the abnormal nozzle, the pass data generating process is stopped in the pass data generating step by the reset command output from the print control section 71 and in complementary data generating step, the pass data for the next pass of the pass in which the abnormal nozzle (the ejection abnormality) is detected is reconstructed further the second complementary recording. Thus, it is possible to promptly start the generation of the pass data for the second complementary recording and to avoid starting delay of the second complementary recording step as much as possible. Thus, even if the second complementary recording is executed, the throughput of recording is not seriously lowered.

(9) The pass data (recording data) for the second complementary recording is reconstructed by using the halftone data generated by the halftone processing section 82 for the next pass (scanning) of the pass (scanning) when the abnormal nozzle Na is detected. Thus, since the generated halftone data is used, it is possible to reconstruct the recording data for the second complementary recording at a relatively short time without need for the halftone processing. As a result, it is possible to suppress delay of starting of the second complementary recording.

Moreover, the embodiment described above can be changed as the following forms.

In a case where a plurality of abnormal nozzles occur, if the medium is transported by the first transport amount such that the normal nozzle is disposed in the dot missing region of the abnormal nozzle, the abnormal nozzle may be disposed on a row of a dot missing region of another abnormal nozzle. Thus, if the plurality of abnormal nozzle are detected, the printing control calculates and determines the first moving amount such that the normal nozzle is disposed in the all rows of the dot missing region corresponding to the plurality of abnormal nozzles. Then, the printing control section controls the transport motor of the transport mechanism and performs the transport of the medium by the determined first transport amount.

In first complementary step, the dot missing region is complemented by the dot by forming the dot with the dot size determined from the printing data, but the dot may be formed with a dot size different from the dot size determined from the printing data.

In the second complementary recording step, an amount obtained by apportioning the dots of the row by a ratio of the size of the dots of both adjacent rows area is added the dots of both adjacent rows and thereby the size of the second dot DT2 (near dot) that is the dots of both adjacent rows is the dot size greater than the dot size determined from the printing data. On the other hand, as illustrated in FIG. 13, the second dots DT2 may be ultra-large dots uniformly. However, in the example of FIG. 13, since the dot that is determined based on the printing data is the large dot, the example is made by the ultra-large dots that is greater than those of the example of FIG. 13, and complementation may be performed with the ultra-large dots uniformly regardless of the dot size that is determined based on the printing data. Moreover, the uniform dot size may be applied to the large dots or the medium dots. If it is the uniform large dots, for example, the small dots and the medium dots are the large dots, and the large dots are left as they are. If it is the uniform medium dots, for example, the small dots are the medium dots and the medium dots and the large dots are left as they are. It is also possible to perform the second complementary recording by these methods. Moreover, the size of the dot using in the usual printing is not limited to the three types of large, medium, and small, and may be one type of the dot size. In this case, the second dot that is greater than the dot size of one type may be used. Moreover, the types of the dot sizes using in the usual printing may be two types, four types, or five types.

The first complementary recording or the second complementary recording may be performed using the normal nozzle only for the dot size of the large dot or the medium dot in which dot missing is conspicuous.

In the first complementary recording step, at least a part of the dot missing region Aom my complemented by the dot by the normal nozzle. For example, a part of the dot missing region may not be complemented. For example, the ejection abnormality of the ejecting section may be detected for every Q dots without detecting the ejection abnormality of the ejecting section D for all dots as the target. In this case, even if the ejection abnormality is initially detected in the pass at this time, a ejection abnormality generating period is present within a period from the previous the ejection abnormality detecting period to the current the ejection abnormality detecting period. Thus, in a case where the complementation of the dot is started from the current the ejection abnormality detecting position, if the ejection abnormality starting position is practically present before the complementation starting position, a portion of the dot missing region Aom, which is practically complemented remains as the dot missing residual region. As described above, a part of the dot missing region Aom may not be complemented.

The first complementation may be performed such that the dot of the complementation extends to a region outside the dot missing region Aom.

The example of the band printing is printed in which the printing is performed using all nozzles capable of using in the nozzles configuring the nozzle column. However, interlaced printing (micro weave printing) may be provided in which printing is performed using a part of nozzles of all nozzles configuring the nozzle column. Even in such an interlaced printing, it is possible to form the dot by using another operation nozzle in the dot missing row.

The dot size of both adjacent rows is changed according to the dot size of the dot which disappears a dot disappearing row, but all dots may have the same size (for example, the large dot or the medium dot).

First complementary recording may be performed using the normal nozzle of ink color different from ink color of the abnormal nozzle. For example, if the abnormal nozzle for black ink is detected in gray scale printing, in the first scanning that is the next scanning, black (composite black) or gray (composite gray) may be developed by mixing the colors of the ink droplets of three colors using the normal nozzle of other three colors. Furthermore, if the nozzle of a predetermined ink color is detected as the abnormal nozzle when color printing is performed, the same color as the ink color of the abnormal nozzle or similar color may be developed by mixing the colors of the ink droplets of a plurality of colors or one color using the normal nozzle of the other three colors in the next first scanning.

The cleaning is not limited to the flushing. For example, head cleaning may be provided in which the ink is forcedly sucked and discharged from the nozzle 26*b* by driving the suction pump 37 in a state where the cap 35 comes into contact with the nozzle opening surface 26*a* of the recording head 26. If the cleaning is completed, the nozzle inspection may be performed by performing the flushing based on the residual vibration signal Vout in the flushing. Furthermore, the cleaning may be wiping. The nozzle inspection may be performed by performing the flushing after wiping based on the residual vibration signal Vout in the flushing.

The detection section may be configured to detect the ejection abnormality with the laser light in the scanning of the recording section. That is, it is detected as the ejection abnormality in a case where the laser light is applied to traverse the flight path of the ink droplets ejected from the nozzle, a receiving section of the laser light is blocked by the ink droplets, the normal nozzle is detected if the laser light is not received, the laser light is not blocked by the ink droplets regardless of the ejecting section D being driven to eject the ink, and the laser light is received.

Each functional section built in the control section of the recording apparatus is implemented by software by a computer executing a program, or may be implemented by hardware by an electronic circuit such as a FPGA (for example, an Application Specific IC (ASIC)), or may be implemented by in cooperation with software and hardware.

The recording apparatus may be a recording system for forming the dots by ejecting liquid while the recording section is moved. The recording apparatus is not limited to the serial printer and may be a lateral type printer. The lateral type printer is configured such that the carriage having the recording head is capable of moving in both directions of the main scanning direction intersecting the nozzle column direction and a sub-scanning direction parallel to the nozzle column direction. In this case, a relative movement of the medium and the recording section in the sub-scanning direction is implemented not by the transport of the medium but by the movement of the recording section (recording head) in the sub-scanning direction. In this case, an example of a moving section is configured by a power source for moving the recording section in the sub-scanning direction and a guide rail for guiding transport section in the sub-scanning direction.

What is claimed is:

1. A recording method for performing recording on a medium by forming dots by ejecting a liquid from nozzles during scanning in which a recording section having a nozzle column formed of a plurality of nozzles is moved in a scanning direction intersecting the nozzle column, the recording method comprising:

detecting an abnormal nozzle by a detection section during scanning by the recording section;

disposing a normal nozzle in a row where dot missing occurs due to an abnormal nozzle by relatively moving a medium and the recording section by a first moving amount that is shorter than a defined normal moving amount used when no abnormal nozzle is detected during scanning;

performing first complementary recording in which at least a part of a dot missing region in which the dot missing occurs in the first scanning is complemented by a first dot which is recorded by the normal nozzle;

relatively moving the medium and the recording section by a second moving amount corresponding to a difference between the defined normal moving amount and the first moving amount; and performing second complementary recording in which a second dot of which a size is greater than a size of a dot determined based on printing data is recorded on a row adjacent to a row of the abnormal nozzle by a normal nozzle that is positioned adjacent to the abnormal nozzle in the nozzle column direction;

wherein the second moving amount is larger than the first moving amount.

2. The recording method according to claim 1, wherein in the performing of the first complementary recording, a size of the first dot that is recorded by the normal nozzle is the size of the dot determined based on the printing data.

3. The recording method according to claim 1, wherein if the detection section detects the abnormal nozzle, recording data that is generated on the premise that the second complementary recording is not performed is discarded and recording data for the first complementary recording is generated.

4. The recording method according to claim 1, wherein in the performing of the second complementary recording, an ejecting section corresponding to the abnormal nozzle is not driven to eject the liquid.

5. The recording method according to claim 4, wherein in the performing of the second complementary recording, the ejecting section corresponding to the abnormal nozzle is driven in a vibration drive mode to vibrate without ejection of the liquid, the detection section performs nozzle inspection by detecting residual vibration of the ejecting section that is driven in the vibration drive mode, and as a result of the nozzle inspection, if the abnormal nozzle is restored to the normal nozzle, the restored normal nozzle is used for recording while from the next scanning or the following the next scanning.

6. The recording method according to claim 5, wherein if the detection section detects that the abnormal nozzle is restored to the normal nozzle in the same scanning as the scanning in which the abnormal nozzle is detected by the detection section, in the performing of the first complementary recording, a range, which includes a position in which the abnormal nozzle is initially detected in scanning before the first scanning and does not include a position in which restoring of the abnormal nozzle to the normal nozzle is detected, is set to the dot missing region.

7. The recording method according to claim 1, wherein when the recording section performs cleaning with ejection of the liquid from the nozzle between scanning and scanning, the detection section examines presence or absence of the abnormal nozzle and if the abnormal nozzle is restored to the normal nozzle from the detection result of the detection section, the performing of the second complementary recording is not performed in the next second scanning.

8. The recording method according to claim 1, further comprising:

generating a plurality pieces of separation data by executing a separating process on printing data;

generating halftone data by executing halftone processing on the plurality pieces of separation data; and generating recording data in which dots for one scanning by the recording section are allocated in a nozzle based on the plurality pieces of halftone data; and generating the recording data for the second complementary recording for recording the second dot by the normal nozzle adjacent to the abnormal nozzle in the second scanning by stopping a recording data generating process in the recording data generating when the detection section detects the abnormal nozzle, wherein in the second complementary recording, the second dot is recorded by the normal nozzle adjacent to the abnormal nozzle by performing recording by the recording section in the second scanning based on the recording data for the second complementary recording.

9. The recording method according to claim 8, wherein the recording data for the second complementary recording is reconstructed by using the halftone data generated by the halftone processing for the next scanning of the scanning in which the abnormal nozzle is detected.

10. A recording apparatus configured to perform recording on a medium by forming dots by ejecting a liquid from nozzles during scanning in which a recording section having a nozzle column formed of a plurality of nozzles is moved in a scanning direction intersecting the nozzle column, the recording apparatus comprising:

a recording section configured to form the dots by ejecting the liquid from the nozzles during scanning in which the recording section is moved in the scanning direction;

a detection section that configured to detect an abnormal nozzle at least during scanning by the recording section;

a moving section that configured to move the recording section and the medium relative to each other; and a control section configured to control the recording section and the moving section, wherein the control section is further configured to perform first complementary recording and second complementary recording, wherein the control section is further configured such that, in the first complementary recording, if the detection section detects the abnormal nozzle, the control section disposes a normal nozzle that is not detected as the abnormal nozzle by the detection section in a row where dot missing occurs due to the abnormal nozzle by relatively moving the medium and the recording section by a first moving amount that is shorter than a defined normal moving amount used when no abnormal nozzle is detected during scanning, and at least a part of a dot missing region in which the dot missing occurs is complemented by a first dot formed by the normal nozzle in the first scanning, and wherein the control section is further configured such that in the second complementary recording, the control section controls the moving section to move the medium and the recording section relative to each other by a second moving amount corresponding to a difference between the normal moving amount and the first moving amount, and thereby in the second scanning, a second dot having a size greater than a size of a dot that is determined based on printing data is recorded by a normal nozzle positioned adjacent to the abnormal nozzle in a nozzle column direction of the abnormal nozzle;

wherein the second moving amount is larger than the first moving amount.

* * * * *